US005237382A

United States Patent [19]

Matsumura

[11] Patent Number: 5,237,382

[45] Date of Patent: Aug. 17, 1993

[54] IMAGE FORMING APPARATUS AND CONTROLLER THEREOF

[75] Inventor: Keiichi Matsumura, Yokohama, Japan

[73] Assignee: Ricoh Company, Ltd., Tokyo, Japan

[21] Appl. No.: 803,059

[22] Filed: Dec. 6, 1991

[30] Foreign Application Priority Data

Dec. 17, 1990 [JP] Japan ..... 2-411165
Sep. 30, 1991 [JP] Japan ..... 3-251623

[51] Int. Cl.[5] ..... G03G 21/00

[52] U.S. Cl. ..... 355/323; 271/298; 355/321; 355/325

[58] Field of Search ..... 355/308, 309, 321, 322, 355/323, 325, 204, 208; 271/287, 288, 298; 270/58

[56] References Cited

U.S. PATENT DOCUMENTS 4,515,464 5/1985 Shigemura et al. ..... 355/323
4,522,486 6/1985 Clark et al. ..... 271/288 X
4,557,589 12/1985 Fukushi ..... 355/323 X
4,980,721 12/1990 Ishikawa et al. ..... 355/323
5,079,598 1/1992 Kaneko et al. ..... 355/309
5,105,231 4/1992 Watanabe et al. ..... 355/323

FOREIGN PATENT DOCUMENTS 60-128462 7/1985 Japan .
0180677 7/1988 Japan ..... 271/288

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

An image forming apparatus includes an input device for inputting the number of copies for every distributing place; a memory for storing the number of copies inputted by the input device; a display for displaying the number of copies; an original automatic feeder for returning an exposed sheet of an original to an uppermost position of this original; a feeder for feeding a sheet to be transferred; a device for reversing the transferred sheet; a collective sorter for collecting and sorting the transferred sheet; a detector for detecting discharge of the transferred sheet; and a discharging controller having first, second and third discharging devices. The first discharging device discharges the transferred sheet to each of bins disposed in the collective sorter in accordance with the number of copies of the original inputted by the input device. The second discharging device arranges and discharges the transferred sheet in a page order of the original. The third discharging device discharges an interleaving sheet of paper every time the transferred sheet is discharged by one copy.

5 Claims, 21 Drawing Sheets

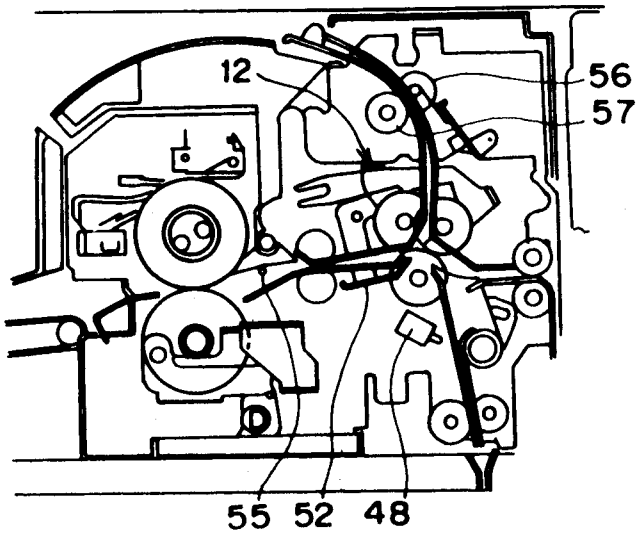
Fig. 8a
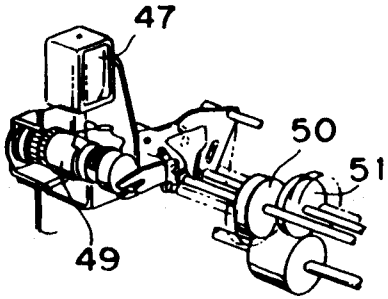
Fig. 8b
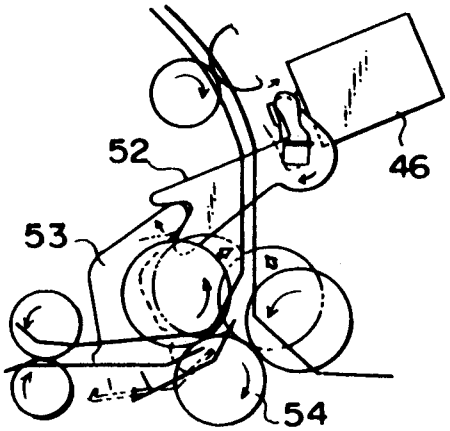
Fig. 8c
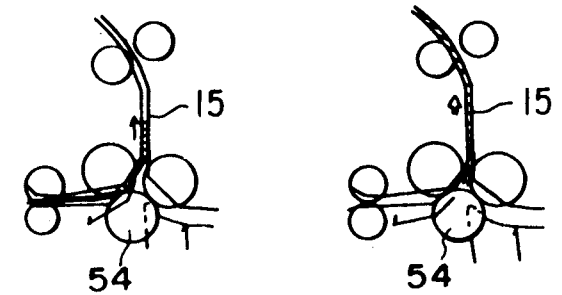
Fig. 8d
Fig. 8e
Fig. 8f
Fig. 8g
Fig. 8h

IMAGE FORMING APPARATUS AND CONTROLLER THEREOF

BACKGROUND OF THE INVENTION

1. Field of the Invention

The present invention relates to an image forming apparatus having a collecting sorter for collecting and sorting transferred sheets and a recyclic automatic document feeder (RADF). The present invention also relates to a controller for controlling an operation of the image forming apparatus.

2. Description of the Related Art

A general collecting sorter has two functions. A first function is a sorting function for arranging transferred sheets discharged from an image forming apparatus in a page order of an original. A second function is a collecting or stacking function for arranging the transferred sheets for every page of the original. In the case of the sorting function, an operator inputs the required number of copies by an input means in advance so that the transferred sheets are discharged onto each of bins disposed in the sorter by the same number as the number of sheets of the original.

In the general image forming apparatus, when the same original is copied and copies thereof are distributed to each of business sections or divisions, required copying numbers are different from each other for every business section or division. Accordingly, it is impossible to cope with such a situation by using the above two functions. Therefore, there is a problem that an operator must count the number of transferred sheets and sort them for every business section after sheets are transferred and completely discharged.

For example, an apparatus for solving such a problem is shown in Japanese Patent Application Laying Open (KOKAI) No. 60-128462. In this apparatus, the number of copies for every distributing place written on an original is read by a light-receiving element and data about this copying number are inputted to a central processing unit (CPU). An apparatus of the sorter section in the central processing unit (CPU) is controlled such that the transferred sheets are discharged to each of the bins in accordance with these data. However, in such a structure, it is necessary to add a light-emitting element and a light-receiving element as hardware to the image forming apparatus and write the number of copies onto the original. Therefore, the structure of the image forming apparatus is complicated and cost thereof is increased and it is very troublesome to operate the image forming apparatus. Further, in the above publication, there is no description about a method for arranging the transferred sheets when the original is constructed by a plurality of sheets.

In general sorting systems, the cost of an entire copying system is increased and a copying machine having each of such sorting systems is disadvantageous in comparison with the general copying machine having a copying machine body cheaply manufactured.

SUMMARY OF THE INVENTION

It is therefore a first object of the present invention to provide an image forming apparatus in which, after a copying operation, a transferred sheet can be discharged onto each of bins in accordance with the number of copies stored to a memory, and working efficiency can be improved by inserting an interleaving sheet every time the transferred sheet is discharged by one copy.

A second object of the present invention is to provide a controller of an image forming apparatus in which, when a plurality of copies are made, copied sheets can be divided or sorted for every copy by inserting an interleaving sheet for every one copy in accordance with necessity so that the working efficiency of an operator can be greatly improved.

A third object of the present invention is to provide a controller of an image forming apparatus in which no interleaving sheet is inserted after a final copy with respect to the plural copies so that there is no useless copy and paper is saved.

A fourth object of the present invention is to provide a controller of an image forming apparatus in which a sheet of paper having a size different from a paper size used in the present copying operation is inserted as an interleaving paper sheet from plural paper feeding means so that respective partitions between copies can be clearly recognized and working efficiency can be improved.

A fifth object of the present invention is to provide a controller of an image forming apparatus in which a sheet of paper fed in a direction different from a feeding direction set in the present copying operation is inserted as an interleaving paper sheet from plural paper feeding means so that respective partitions between copies can be clearly recognized and working efficiency can be improved.

A sixth object of the present invention is to provide a controller of an image forming apparatus in which at least one of image forming processing means is not operated in a process for making a white paper copy so that it is possible to make a white paper copy having no slight image and no dirty portion on an interleaving sheet copied as a white paper sheet.

A seventh object of the present invention is to provide a controller of an image forming apparatus in which no optical scanning means for scanning an original is operated in a process for making a white paper copy so that no time required to perform the scanning operation is uselessly wasted and no power of a light source used within a scanning unit is uselessly consumed.

An eighth object of the present invention is to provide a controller of an image forming apparatus in which no charger for charge in image forming processing means is operated in a process for making a white paper copy and no charge is moved onto a photosensitive body so that it is possible to make a white paper copy having no slight image and no dirty portion on an interleaving sheet copied as a white paper sheet.

A ninth object of the present invention is to provide a controller of an image forming apparatus in which no transfer charge in image forming processing means is operated in a process for making a white paper copy and no image on a photosensitive body is transferred onto a sheet of paper so that it is possible to make a white paper copy having no slight image and no dirty portion on an interleaving sheet copied as a white paper sheet.

In accordance with a first structure of the present invention, the above first object can be achieved by an image forming apparatus comprising input means for inputting the number of copies for every distributing place; memory means for storing the number of copies inputted by the input means for every distributing place;

display means for displaying the number of copies inputted by the input means for every distributing place; original automatic feeding means for returning an exposed sheet of an original to an uppermost position of this original; means for feeding a sheet to be transferred; means for reversing the transferred sheet; collective sorting means for collecting and sorting the transferred sheet; means for detecting discharge of the transferred sheet; and transferred-sheet separate-section-copying-number page-order interleaving-sheet discharging control means having separate-section copying-number discharging means, page-order discharging means and interleaving-sheet discharging means. The separate-section copying-number discharging means discharges the transferred sheet to each of bins disposed in the collective sorting means in accordance with the number of copies of the original inputted by the input means for every distributing place. The page-order discharging means arranges and discharges the transferred sheet in a page order of the original. The interleaving-sheet discharging means discharges an interleaving sheet of paper every time the transferred sheet is discharged by one copy.

In accordance with a second structure of the present invention, the above second object can be achieved by a controller of an image forming apparatus having at least image forming processing means and optical scanning means within an apparatus body and a recyclic automatic original feeder outside the apparatus body; the controller comprising white-paper copying-mode selecting means capable of selecting a mode for discharging an interleaving sheet of paper as a white paper copy every time one of plural copies is completely made.

In accordance with a third structure of the present invention, the white-paper copying-mode selecting means in the second structure is constructed such that no interleaving sheet as a white paper copy is inserted after a final copy with respect to the plural copies.

In accordance with a fourth structure of the present invention, the above fourth object can be achieved by a controller of an image forming apparatus having at least image forming processing means and optical scanning means within an apparatus body and a recyclic automatic original feeder and a plurality of paper feeding means outside the apparatus body; the plural paper feeding means feeding a sheet of paper having a size different from a copying size used at the present time every time one of plural copies is completely made; the controller comprising paper-size-changing white-paper copying-mode selecting means capable of selecting a mode for discharging this fed sheet of paper as an interleaving sheet of a white paper copy.

In accordance with a fifth structure of the present invention, the above fifth object can be achieved by a controller of an image forming apparatus having at least image forming processing means and optical scanning means within an apparatus body and a recyclic automatic original feeder and a plurality of paper feeding means outside the apparatus body; the plural paper feeding means capable of feeding a sheet of paper in different directions; the plural paper feeding means feeding the sheet of paper in a direction different from a feeding direction set at the present time every time one of plural copies is completely made; the controller comprising feeding-direction-changing white-paper copying-mode selecting means capable of selecting a mode for discharging this fed sheet of paper as an interleaving sheet of a white paper copy.

In accordance with a sixth structure of the present invention, at least one of the image forming processing means is not operated in a process for making the white paper copy in the second, fourth and fifth structures.

In accordance with a seventh structure of the present invention, no optical scanning means for scanning an original is operated in a process for making the white paper copy in the second, fourth and fifth structures.

In accordance with an eighth structure of the present invention, the image forming processing means is constructed by a charger for charge in the sixth structure.

In accordance with a ninth structure of the present invention, the image forming processing means is constructed by a transfer charger in the sixth structure.

In the first structure of the present invention, an operator inputs the number of distributed copies for every business section by the input means as an operating section. Data indicative of the number of distributed copies for every business section are stored to a memory in an inputting order. After a copying operation is performed, a transferred sheet can be discharged onto each of the bins in the collective sorting means in accordance with the number of copies stored to the memory. Further, working efficiency can be improved by inserting an interleaving sheet by the interleaving sheet discharging means every time the transferred sheet is discharged by one copy.

In the second structure of the present invention, when a plurality of copies are made by the white-paper copying-mode selecting means, it is possible to divide or sort copied sheets for every copy by inserting an interleaving for every one copy in accordance with necessity. Thus, the working efficiency of an operator can be greatly improved.

In the third structure of the present invention, no interleaving sheet is inserted after a final copy with respect to the plural copies so that there is no useless copy and paper is saved.

In the fourth structure of the present invention, a sheet of paper having a size (e.g., a larger size) different from a paper size used in the present copying operation is inserted as an interleaving paper sheet from the plural paper feeding means by the paper-size-changing white-paper copying-mode selecting means. Accordingly, respective partitions between the copies can be clearly recognized so that working efficiency can be improved.

In the fifth structure of the present invention, a sheet of paper fed in a direction different from a feeding direction set in the present copying operation is inserted as an interleaving paper sheet from the plural paper feeding means by the feeding-direction-changing white-paper copying-mode selecting means. Accordingly, respective partitions between the copies can be clearly recognized so that working efficiency can be improved.

In the sixth structure of the present invention, at least one of the image forming process means is not operated in a process for making the white paper copy. Accordingly, it is possible to make a white paper copy having no slight image and no dirty portion on an interleaving sheet copied as a white paper sheet.

In the seventh structure of the present invention, no optical scanning means for scanning an original is operated in a process for making the white paper copy. Accordingly, no time required to perform the scanning operation is uselessly wasted and no power of a light source used within a scanning unit is uselessly consumed.

In the eighth structure of the present invention, no charger for charge in the image forming processing means is operated in a process for making the white copy. Accordingly, no charge is moved onto a photosensitive body so that it is possible to make a white paper having no slight image and no dirty portion on an interleaving sheet copied as a white paper sheet.

In the ninth structure of the present invention, no transfer charger in the image forming processing means is operated in a process for making the white paper copy. Accordingly, no image on a photosensitive body is transferred onto a sheet of paper so that it is possible to make a white paper copy having no slight image and no dirty portion on an interleaving sheet copied as a white paper sheet.

Further objects and advantages of the present invention will be apparent from the following description of the preferred embodiments of the present invention as illustrated in the accompanying drawings.

BRIEF DESCRIPTION OF THE DRAWINGS

FIGS. 8*a* to 8*h* are explanatory views showing operations of a reversing unit mechanism;

DESCRIPTION OF THE PREFERRED EMBODIMENTS

The preferred embodiments of an image forming apparatus and a controller thereof in the present invention will next be described in detail with reference to the accompanying drawings.

Figure 1:
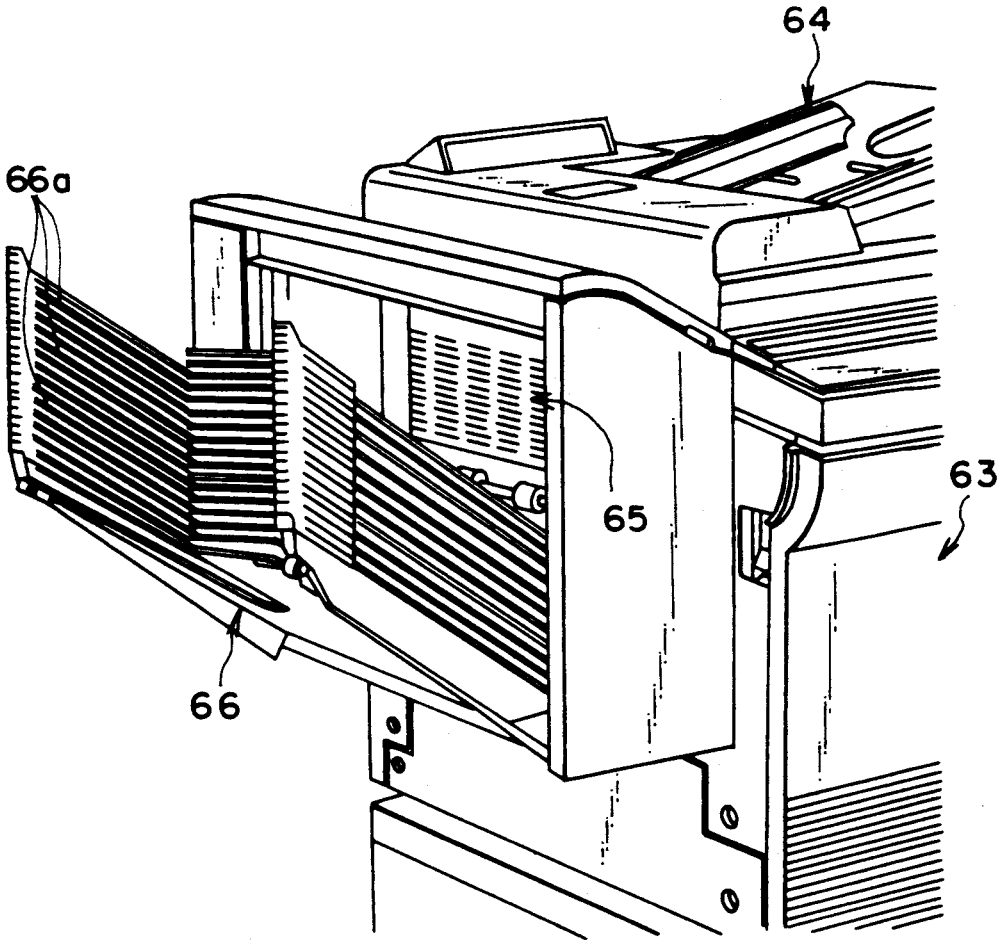
Fig. 1 PRIOR ART
FIG. 1 is a perspective view showing the arrangement of a general image forming apparatus having a plurality of bins for a sorter.

FIG. 1 shows the structure of a general image forming apparatus. This image forming apparatus is constructed by a copying machine body 63 and an automatic document feeder (ADF) 64 disposed on this copying machine body 63. A paper discharging section 65 is disposed on a side of the copying machine body 63. A sorter section 66 is disposed in this paper discharging section 65. In this case, a plurality of copies can be made and sorted by feeding copied sheets one by one onto each of bins 66*a* disposed in the sorter section 66.

Figure 2:
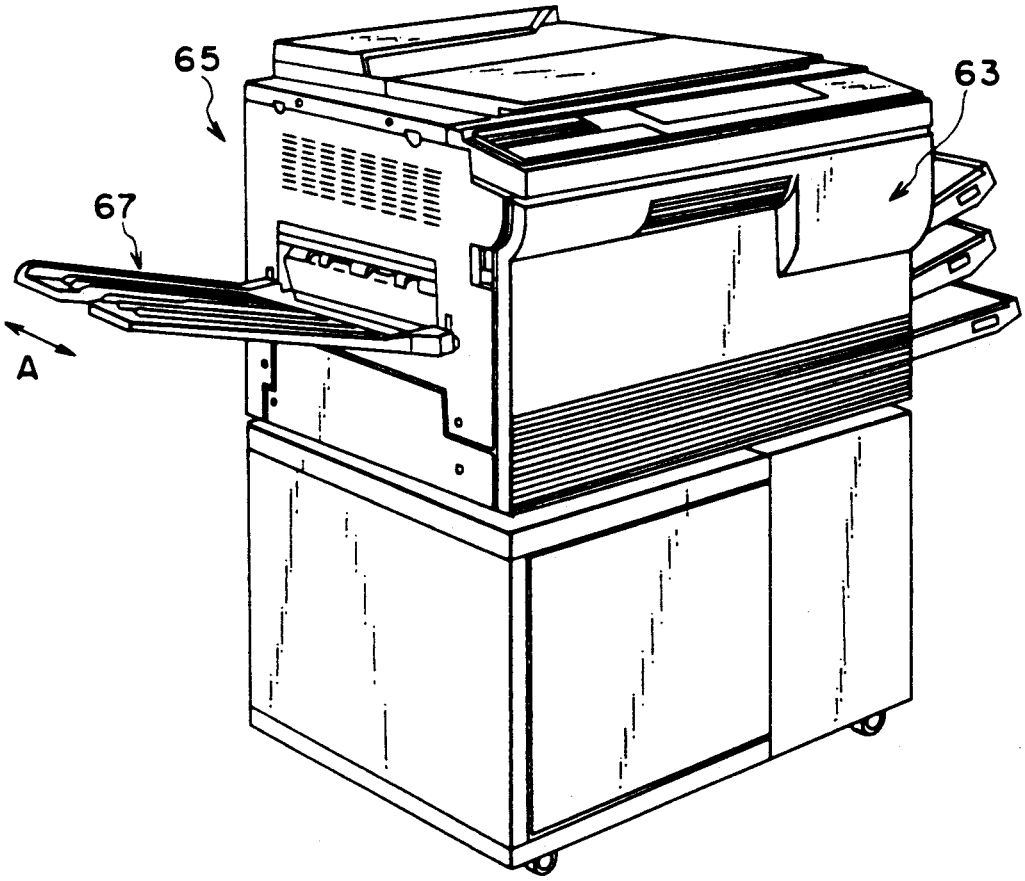
Fig. 2 PRIOR ART
FIG. 2 is a perspective view showing the arrangement of another general image forming apparatus having a discharging mechanism of a doggy tail system.

FIG. 2 shows an example of a sorting system different from the above sorting system in the image forming apparatus. In this sorting system, a paper discharging tray 67 is attached to a paper discharging section 65 disposed on a side of a copying machine body 63. In a sorting operation of plural copies, delimitation of every copy can be judged by moving the paper discharging tray 67 in an arrow direction A every time the plural copies are completely made. This system is called a doggy tail system. Thus, time and labor in copying operation of an operator are reduced and business work can be efficiently done by using the sorting system for sorting copied sheets into each of the bins 66*a* in the sorter section 66 for plural copies, or the doggy tail system for sorting copied sheets by moving the paper discharging tray 67 every time each of the plural copies is completely made.

However, when the same original is copied and copies thereof are distributed to each of business sections or divisions, required copying numbers are different from each other for every business section or division. Accordingly, it is impossible to cope with such a situation by using the above two functions. Therefore, there is a problem that an operator must count the number of transferred sheets and sort them for every business section after sheets are transferred and completely discharged.

An apparatus for solving such a problem is shown in Japanese Patent Application Laying Open (KOKAI) No. 60-128462. In this apparatus, the number of copies for every distributing place written on an original is read by a light-receiving element and data about this copying number are inputted to a central processing unit (CPU). An operation of the sorter section in the central processing unit (CPU) is controlled such that the transferred sheets are discharged to each of the bins in accordance with this data. However, in such a structure, it is necessary to add a light-emitting element and a light-receiving element as hardware to the image forming apparatus and write the number of copies onto the original. Therefore, the structure of the image forming apparatus is complicated and cost thereof is increased and it is very troublesome to operate the image forming apparatus. Further, in the above publication, there is no description about a method for arranging the transferred sheets when the original is constructed by a plurality of sheets.

In the sorting systems shown in FIGS. 1 and 2, it is necessary to arrange the sorter section 66 having many bins 66*a* and the movable paper discharging tray 67 in the paper discharging section 65. Accordingly, the cost of an entire copying system is increased and a copying machine having each of such sorting systems is disadvantageous in comparison with the general copying machine having the copying machine body 63 cheaply manufactured.

An image forming apparatus having a first structure in accordance with a first embodiment of the present invention will next be described with reference to FIGS. 3 to 15.

In the first embodiment of the present invention, the image forming apparatus comprises input means for inputting the number of copies for every distributing place; memory means for storing the number of copies inputted by the input means for every distributing place; display means for displaying the number of copies inputted by the input means for every distributing place; original automatic feeding means for returning an exposed sheet of an original to an uppermost position of this original; means for feeding a sheet to be transferred; means for reversing the transferred sheet; collective sorting means for collecting and sorting the transferred sheet; means for detecting discharge of the transferred sheet; and transferred-sheet separate-section-copying-number page-order interleaving-sheet discharging control means having separate-section copying-number discharge means, page-order discharging means and interleaving-sheet discharging means. The separate-section copying-number discharging means discharges the transferred sheet to each of bins disposed in the collective sorting means in accordance with the number of copies of the original inputted by the input means for every distributing place. The page-order discharging means arranges and discharges the transferred sheet in a page order of the original. The interleaving-sheet discharging means discharges an interleaving sheet of paper every time the transferred sheet is discharged by one copy.

Structures of the above constructional means in the image forming apparatus will next be described sequentially.

Figure 3:
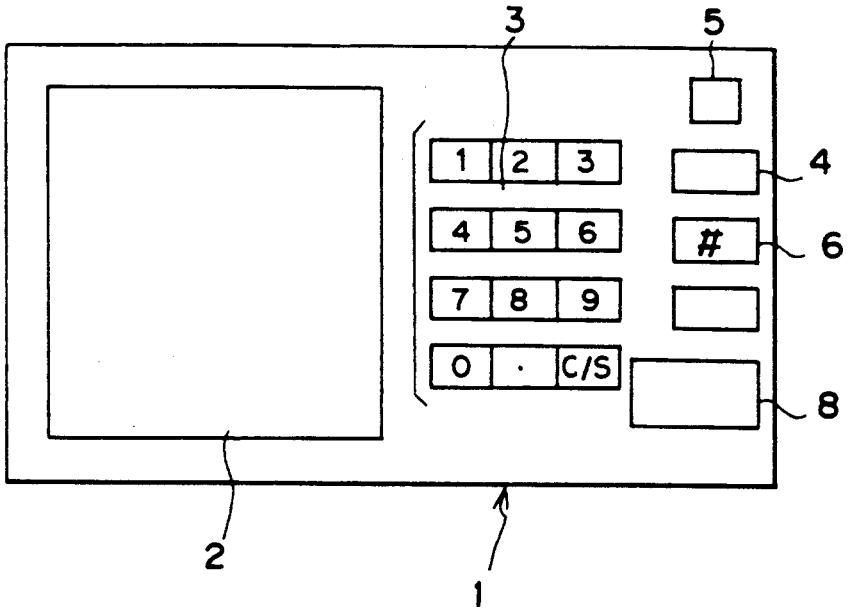
FIG. 3 is a front view showing an operating section disposed in an image forming apparatus having a first structure in accordance with a first embodiment of the present invention.

FIG. 3 shows an operating section 1 as an input means in the image forming apparatus. The operating section 1 has a display 2 as a display means, ten keys 3 and keys for various kinds of controls. An operator pushes a mode selecting key 4 to select a section mode and a sorting mode. At this time, an LED 5 is turned on and shows that theses modes are selected. The operator then inputs the number of distributed sheets for every copying number by pushing the ten keys 3 and an enter key 6. This inputted number of distributed sheets is stored to a non-volatile RAM 7 shown in FIG. 15 and is also displayed by the display 2. After the number of distributed sheets is completely inputted, a normal copying operation of the image forming apparatus as a copying machine is started when the operator pushes a print starting key 8.

Figure 4:
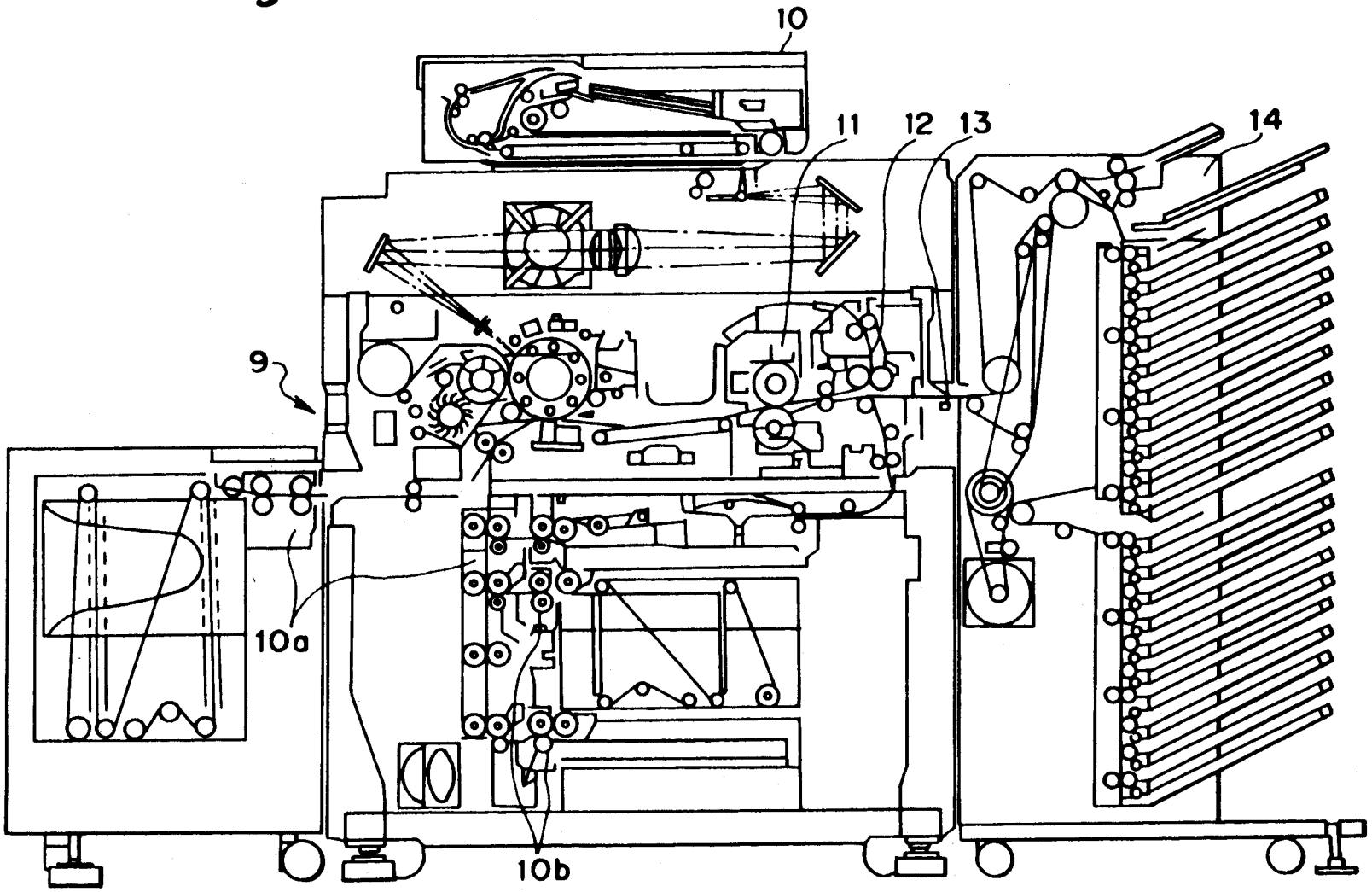
FIG. 4 is a side view schematically showing the image forming apparatus in the present invention.

FIG. 4 shows a schematic entire structure of the image forming apparatus. In FIG. 4, an original-recyclic automatic feeder 10 (which is called an RDH 10 in the following description) is disposed in an upper portion of an apparatus body 9 as a means for automatically feeding an original. An unillustrated transferred sheet is transmitted from a feeding section 10*a* as a feeding means to a fixing unit 11. Thereafter, the transferred sheet is reversed by a reversing unit 12 as a reversing means. A discharging state of the transferred sheet is detected by a discharging sensor 13 as a detecting means. The transferred sheet is then discharged to a sorter 14 as a collective sorting means. An interleaving or untransferred sheet of paper is fed and discharged from a feeding unit 10*b* to the sorter 14.

In this case, it is possible to confirm that a designated number of sheets are discharged to a designated bin by counting the number of turning-on and turning-off operations of the discharging sensor 13. Namely, it is possible to confirm that a designated number of sheets are discharged to a designated bin by counting the number of discharged sheets.

Figure 5:
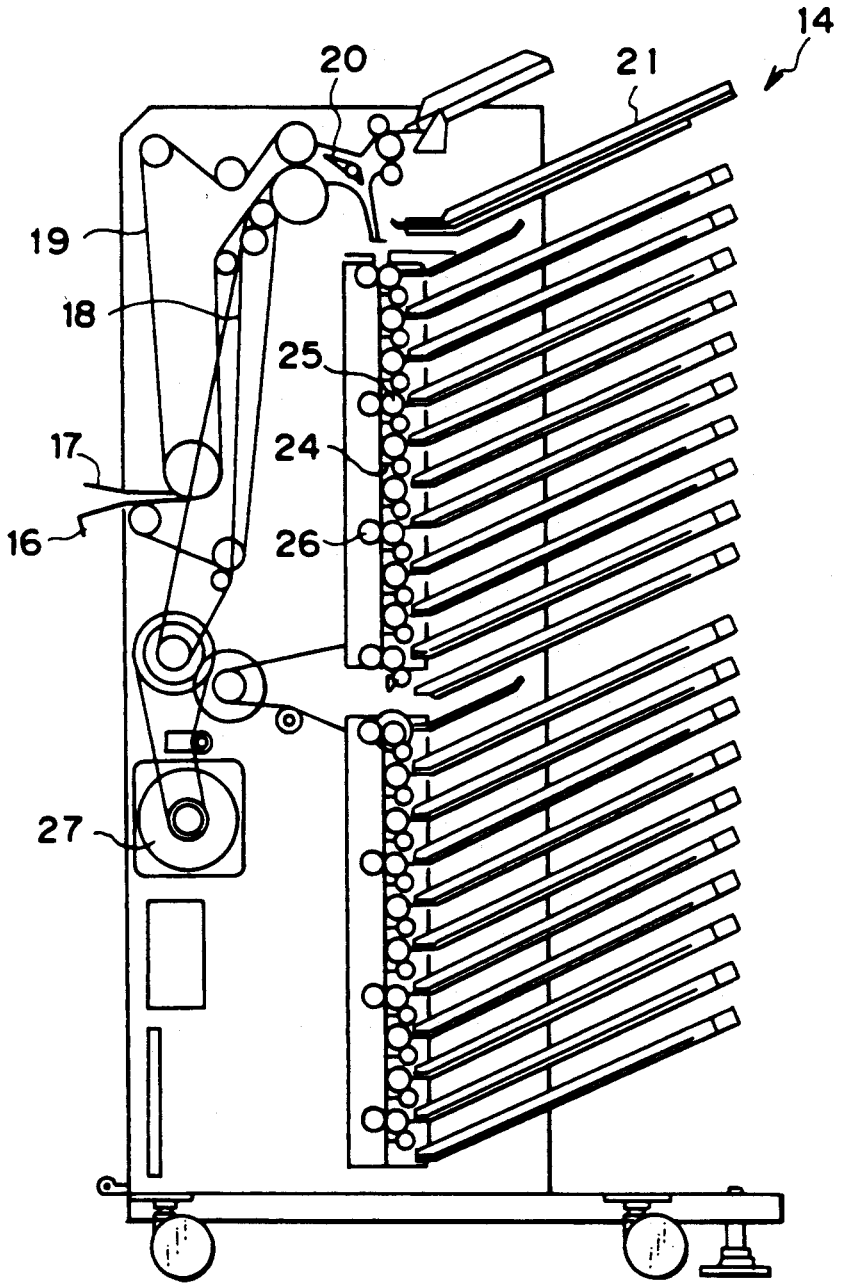
FIG. 5 is a side view showing the structure of a sorter mechanism disposed in the image forming apparatus in the present invention.
Figure 6:
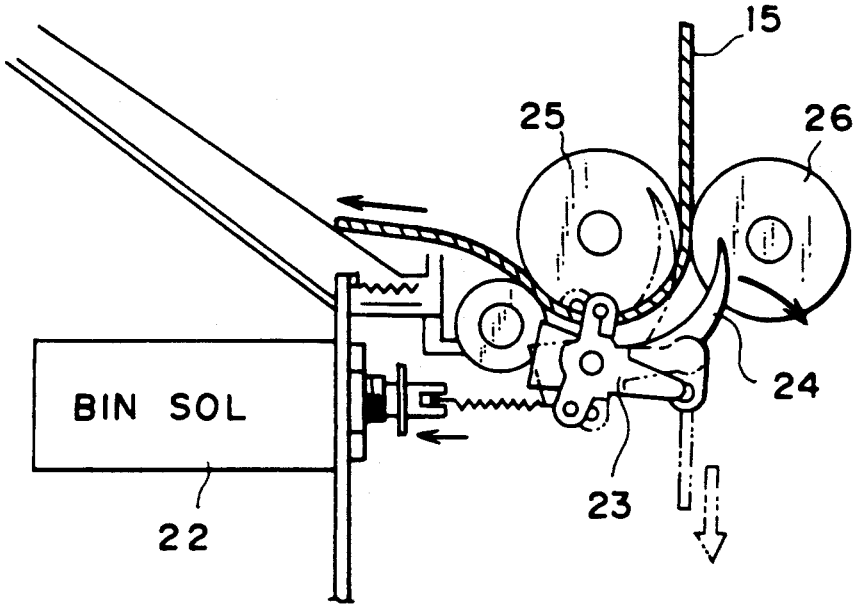
FIG. 6 is a side view showing the structure of a distributing section of a sorter.

FIG. 5 shows a schematic mechanism of the above sorter 14. FIG. 6 shows the mechanism of a distributing section of the sorter 14. In FIG. 5, a transferred sheet 15 is transmitted into the sorter 14 through a space formed between inlet guide plates 16 and 17. The transferred sheet 15 is then conveyed by conveying belts 18 and 19 in a state in which the transferred sheet 15 is supported between these conveying belts. The transferred sheet 15 is further fed by a switching claw 20 to a discharging tray or bin 21. In FIG. 6, a bin solenoid (bin SOL) 22 is normally turned off so that no conveyance of the transferred sheet 15 is prevented by this bin solenoid 22. When this bin solenoid (bin SOL) 22 is turned on, a deflecting lever 23 is rotated from a position shown by a broken line to a position shown by a solid line in an arrow direction in FIG. 6. Thus, a deflecting claw 24 is also moved to a position shown by a solid line. Thus, the transferred sheet 15 conveyed by a conveying roller 25 and a driven roller 26 is guided by the deflecting claw 24 and is then stored onto the discharging tray 21. The conveying belts 18 and 19 are rotated by a drive motor 27. The bin solenoid 22 is turned on and off when the transferred sheet 15 is completely discharged onto the predetermined discharging tray 21. Namely, the bin solenoid 22 is turned on and off when the number of turning-on and turning-off operations of the discharging sensor 13 is in conformity with a number shown by data inputted to a memory.

A schematic mechanism of the above original-recyclic automatic feeder (RDH) 10 will next be described sequentially with reference to FIGS. 7*a* to 7*f*. FIG. 7*a* shows a mechanism for separating front ends of sheets of an original from each other. A hole is disposed in an air knife casing 28 and air is sent toward a central portion of the unillustrated original by operating a blower motor 29 to separate the original sheets from each other. Thus, it is possible to prevent the original sheets from being fed in an overlapping state when the original sheets are fed.

Figure 7C:
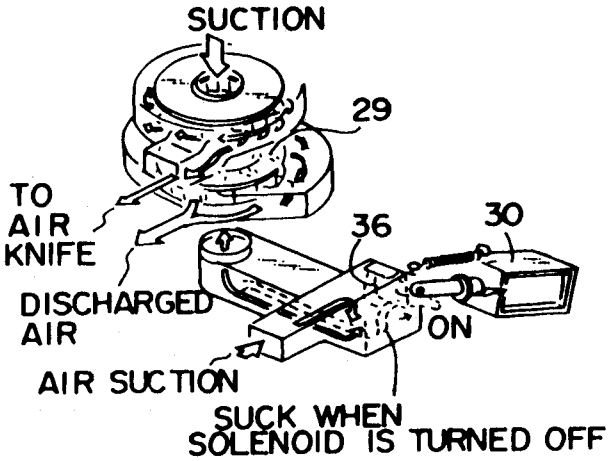
FIGS. 7*a* to 7*f* are exploded perspective views showing the structure of an RDH mechanism.
Figure 7F:
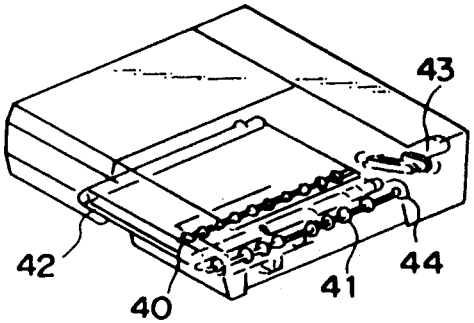
Figure 7B:
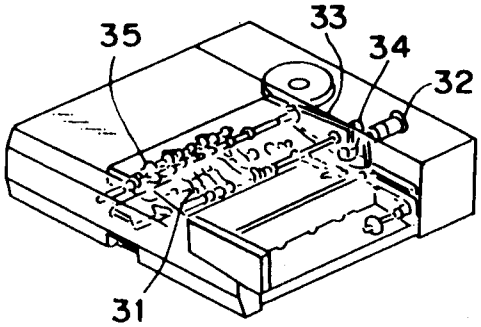

FIGS. 7*b* and 7*c* show a paper feeding mechanism. When the original sheets are separated from each other by the blower motor 29, a shutter solenoid (shutter SOL) 30 attached to the blower motor 29 is operated by receiving a paper feeding signal from the apparatus body. Thus, a lowermost sheet of the original is adsorbed onto a face of a vacuum belt 31. A paper feeding motor 32 is next turned on and the vacuum belt 31 is rotated through the operations of a timing belt 33 and a paper feeding MC 34 so that the original is conveyed until a paper feed roller 35. Such a paper feeding operation using separation and suction of the original sheets with respect to an air knife is performed by disposing two thin fans in the single blower motor 29. When the shutter solenoid (SOL) 30 is turned off, no original is sucked since the original is sucked from a partition valve 36.

Figure 7E:
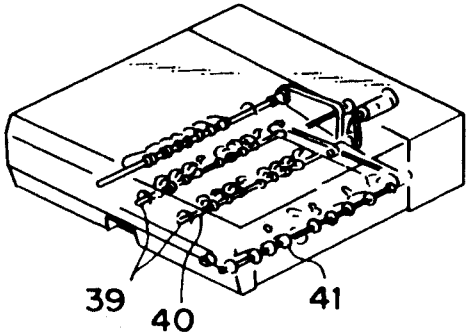
Figure 7A:
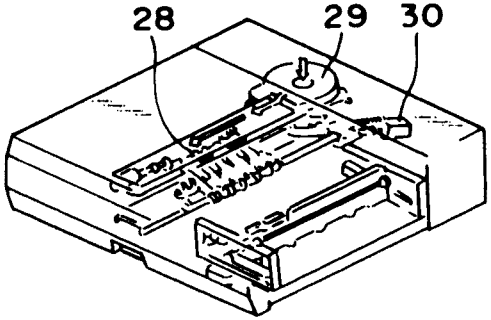
Figure 7D:
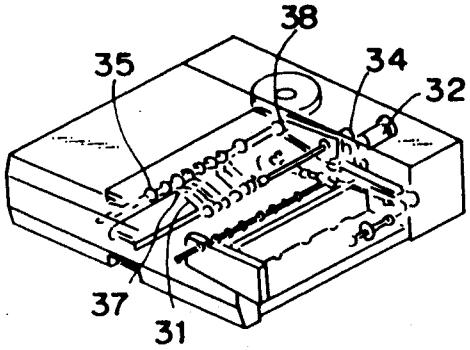

FIGS. 7*d* to 7*f* show a mechanism for conveying original sheets. A sheet of the original is fed by the vacuum belt 31 from a lowermost face of the original. This vacuum belt 31 is moved by operating the paper feeding motor 32 and the paper feeding MC 34 and a driven roller 37 is formed in the shape of a drum. Accordingly, the vacuum belt 31 is rotated without causing any shift in position. Driving force of the paper feeding motor 32 is transmitted to the paper feed roller 35 through a one-way clutch (CL) 38 and a driven portion comes in press contact with the paper feed roller 35 by the resilient force of a spring, thereby rotating the driven portion. Two conveying rollers 39 are rotated by operating the paper feeding motor 32. A driven roller 40 comes in press contact with each of the conveying rollers 39 by the resilient force of a leaf spring so that the original is conveyed to a rightward turn roller 41. This rightward turn roller 41 is rotated by operating the paper feeding motor 32 and a conveying belt 42 is moved by the operation of a conveying motor 43. A one-way clutch (CL) 44 is disposed within the rightward turn roller 41 so as not to prevent a conveying operation of the original after the original is supported and conveyed by the conveying belt 42. The one-way clutch 44 is also disposed to easily remove a jammed original from the conveying belt 42. The driven roller 40 comes in contact with an inner face of the conveying belt 42 by the resilient force of a spring and is rotated within the conveying belt 42. Thus, a dead weight of the driven roller 40 is applied to the conveying belt 42 so as to prevent the original from being moved upward from a contact glass face. The conveying motor 43 is also rotated in a reverse direction since it is necessary to reversely rotate the conveying belt 42 and make the original hit against a scale.

A schematic mechanism of the above reversing unit 12 will next be described sequentially with reference to FIGS. 8*a* to 8*h*. A return solenoid (SOL) 45, a reverse branching solenoid (SOL) 46, a reversing solenoid (SOL) 47 and a branching solenoid (SOL) 48 are turned off at a normal discharging time of a transferred sheet 15 of the original with respect to a front face thereof. Therefore, as shown in FIG. 8*a*, the transferred sheet 15 is discharged as it is. When an electric signal is then transmitted to the reversing solenoid (SOL) 47 from a body control board, the reversing solenoid 47 is turned on and a front reversing roller 50 and a rear reversing roller 51 are moved by the operation of a reversing clutch 49 to positions shown by dotted lines in FIG. 8*b*. Simultaneously, the refers branching solenoid 46 is turned on and a lever auxiliary guide plate 52 and an auxiliary guide plate 53 are respectively moved in arrow directions shown in FIG. 8*c*. Thus, the auxiliary guide plate 53 is raised and located above a main reversing roller 54. The reversing branching solenoid 46 is turned off after a set time has passed since a front end of the transferred sheet 15 reached a fixing sensor 55. Thus, the auxiliary guide plate 53 is lowered from the main reversing roller 54 to prepare a reversing operation of the transferred sheet as shown in FIGS. 8*d* and 8*e*. The return solenoid 45 is turned on after a set time has passed since a rear end of the transferred sheet passed through the fixing sensor 55. Thus, a hitting roller 56 comes in press contact with a reverse return roller 57 so that the transferred sheet 15 is reversed as shown in FIG. 8*f*. The reverse branching solenoid 46 is again turned on after a set time has passed since the return solenoid 45 was turned on. Thus, the auxiliary guide plate 53 is raised from the main reversing roller 54 to prepare the next sheet-receiving operation as shown in FIG. 8*g*. As shown in FIG. 8*h*, the return solenoid 45 is turned off after a set time has passed. The reversed transferred sheet 15 is discharged as it it since the branching solenoid 48 is turned off.

The next description relates to a transferred-sheet separate-section-copying-number page-order interleaving-sheet discharging control means constituting a main portion of the image forming apparatus in the present invention. This separate-section-copying-number page-order interleaving-sheet discharging control means has a separate-section copying-number discharging means for discharging the transferred sheet 15 to each of the bins in the sorter 14 in accordance with the number of copies of the original inputted by the operating section 1 for every distributing place. The separate-section-copying-number page-order interleaving-sheet discharging control means also has a page-order discharging means for arranging and discharging the transferred sheet 15 in a page order of the original. The separate-section-copying-number page-order interleaving-sheet discharging control means also has an interleaving-sheet discharging means for discharging an unillustrated interleaving sheet of paper every time the transferred sheet 15 is discharged by one copy. The separate-section copying-number discharging means, the page-order discharging means and the interleaving-sheet discharging means are not shown in the drawings.

Figure 9:
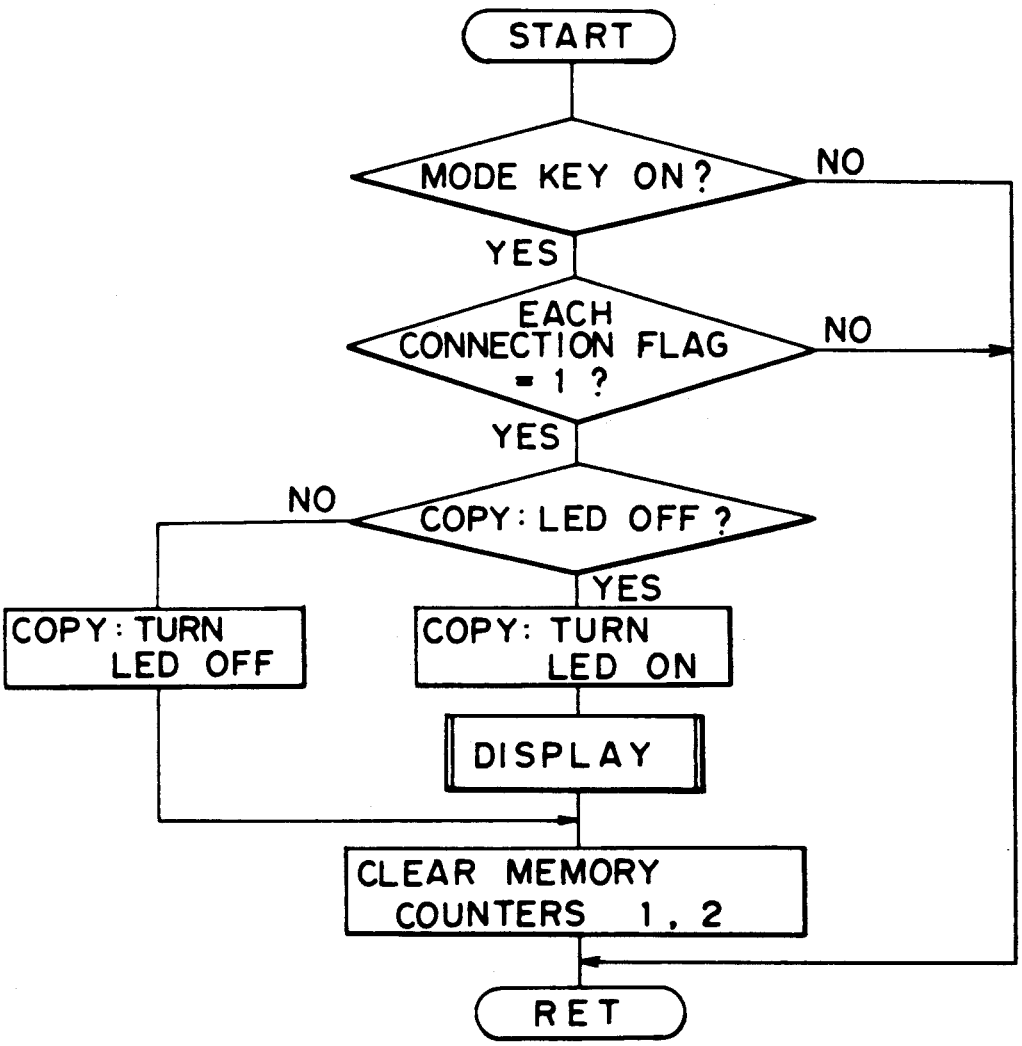
FIG. 9 is a flow chart showing an operation of the image forming apparatus when a separate section sorting mode is selected at the time of a key input.

FIGS. 9 to 13 are flow charts showing concrete processings of this transferred-sheet separate-section-copying-number page-order interleaving-sheet discharging control means. These processings of this control means will next be described sequentially. FIG. 9 shows first processing of this control means at a key inputting time. This first processing relates to a control operation of the image forming apparatus when a separate-section sorting mode is selected by an operator. In this case, when a key for this mode is pushed by the operator, the sorting mode is selected and the LED 5 is turned on and the display 2 displays that this sorting mode is selected. When this mode key is again pushed, the sorting mode is cleared and the LED 5 is turned off.

Figure 10:
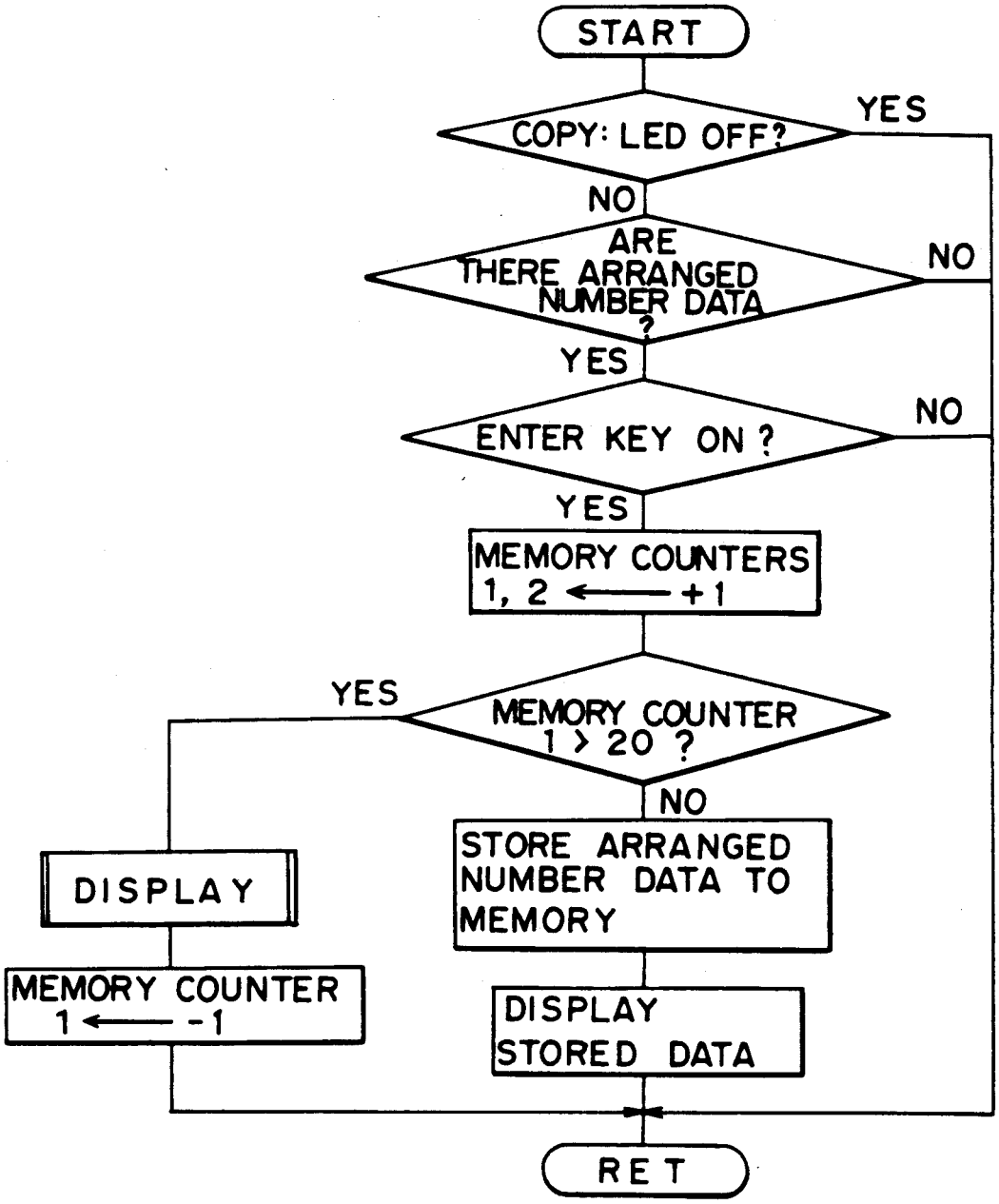
FIG. 10 is a flow chart showing an operation of the image forming apparatus when the number of copies every section or division is inputted at the time of a key input.

FIG. 10 shows second processing at a key inputting time. This second processing relates to a control operation of the image forming apparatus when the number of distributed sheets is inputted by an operator for every business section or division. In this case, data indicative of this sheet number are inputted by pushing the ten keys and the enter key and are stored to an unillustrated memory in an inputting order. These inputted data are displayed by the display 2. When the sheet number shown by the inputted data exceeds a certain number such as 20 indicative of the number of bins, the display 2 displays this exceeding state.

Figure 11:
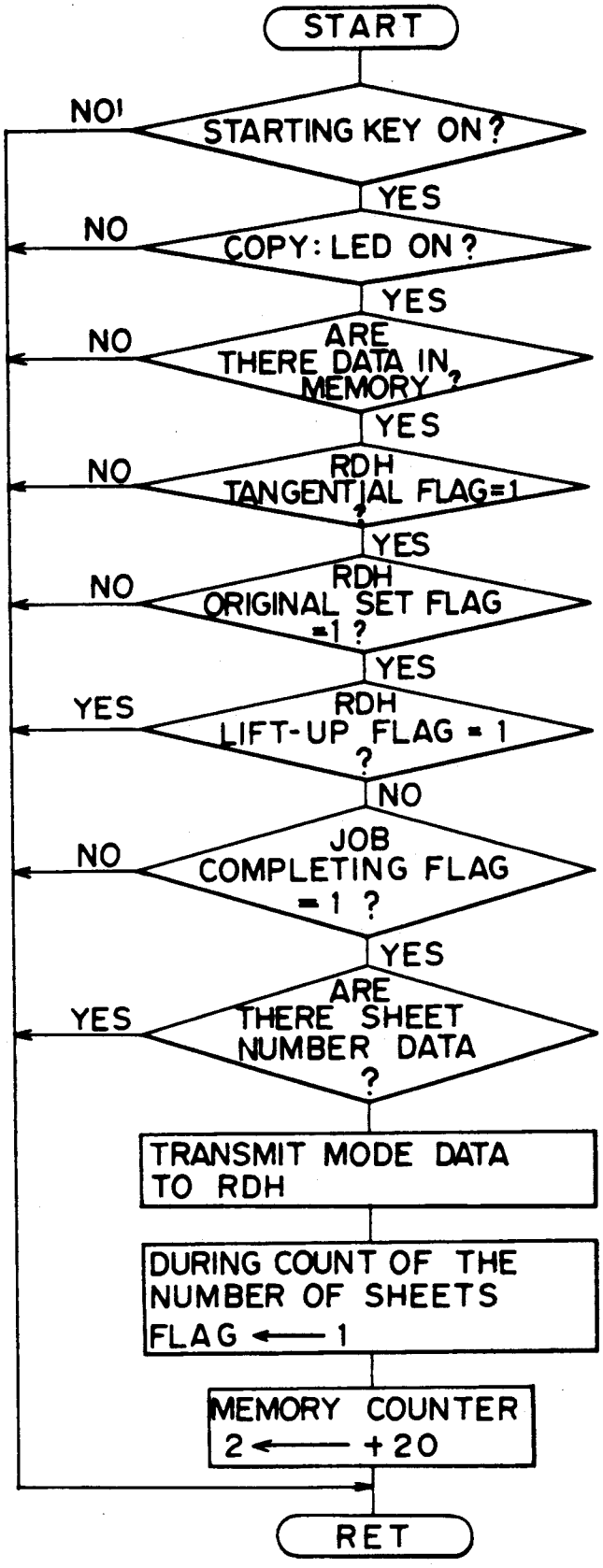
FIG. 11 is a flow chart showing processing for counting the number of original sheets.

FIG. 11 shows processing for counting the number of sheets of the original. This processing relates to a control operation of the image forming apparatus when the number of sheets of the original set on an original base of the original-recyclic automatic feeder (RDH) 10 is counted. In this case, the number of original sheets is counted when a mode for counting the number of original sheets is selected and data indicative of this number are inputted and a starting key is pushed.

Figure 12:
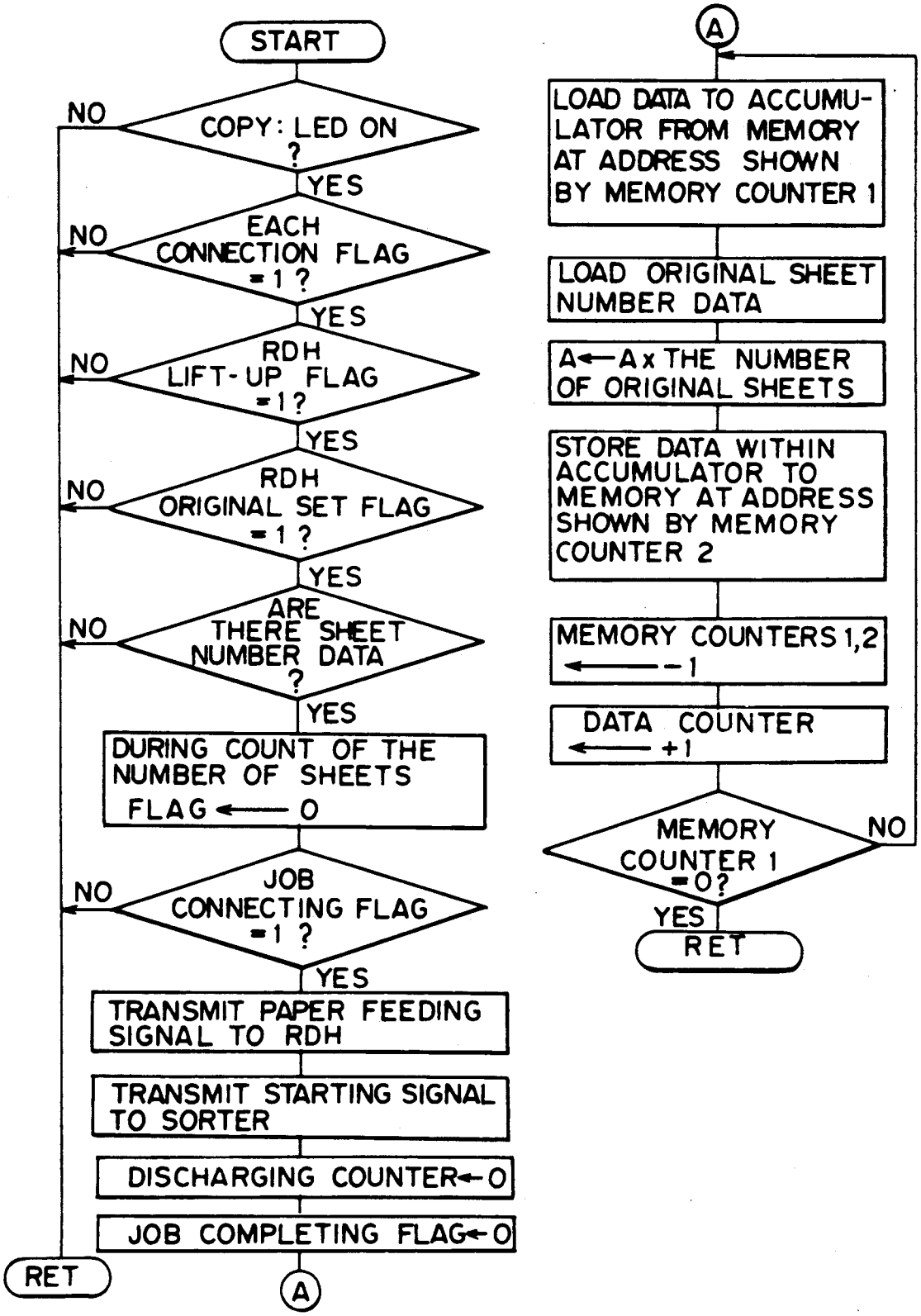
FIG. 12 is a flow chart showing processing for starting a copying JOB.

FIG. 12 shows processing for starting a copying JOB. This processing relates to a control operation of the image forming apparatus when a separate-section sorting mode is selected and the copying JOB is started. In this case, an electric signal is transmitted to the original-recyclic automatic feeder (RDH) 10 and the sorter 14 after electric connections of this feeder 10 and the sorter 14 are confirmed and it is further confirmed that there are data about the number of original sheets and no copying JOB is done.

Figure 13A:
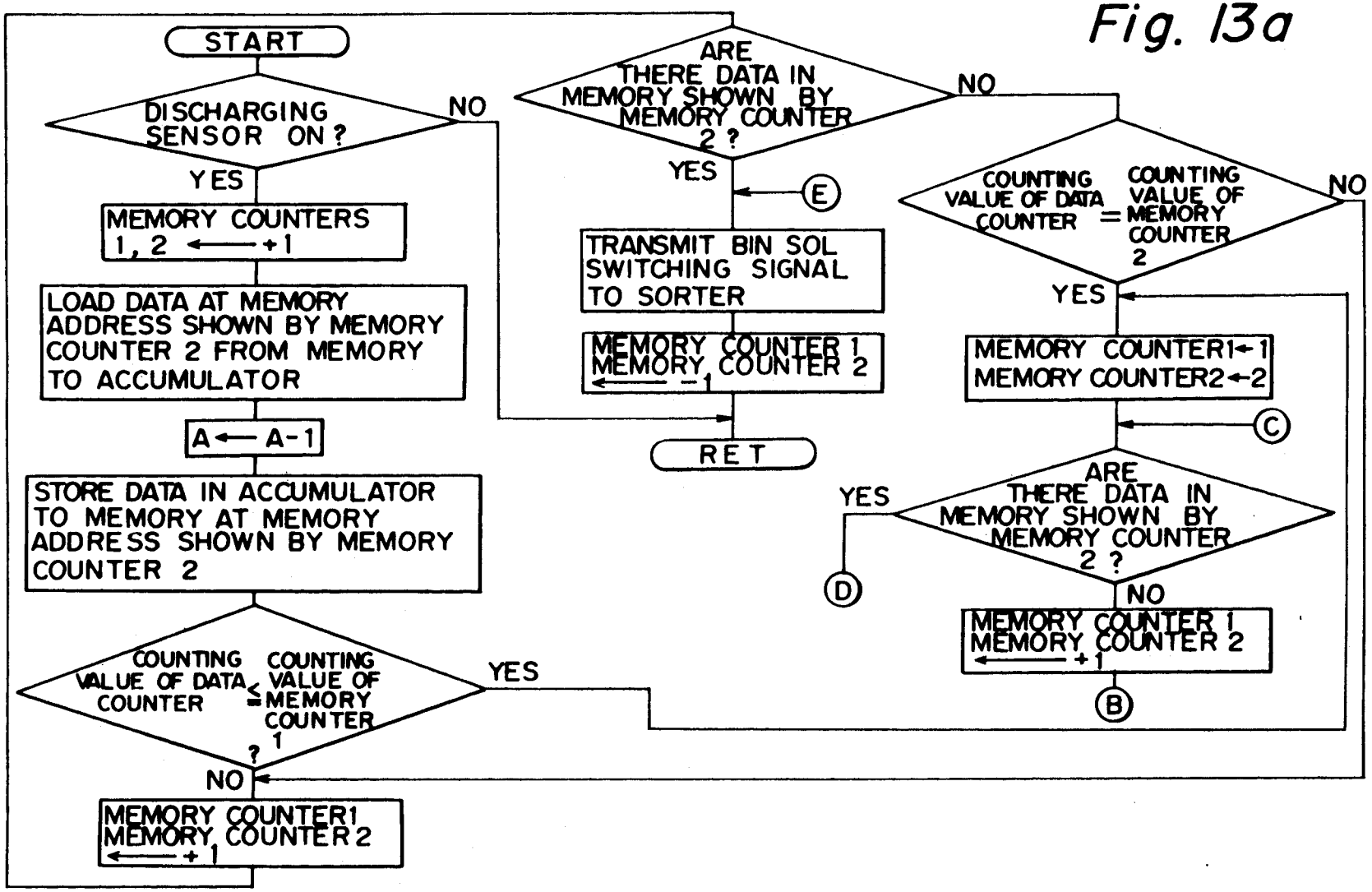
FIGS. 13*a* and 13*b* are flow charts showing an operation of the image forming apparatus at a discharging time of a transferred sheet.
Figure 13B:
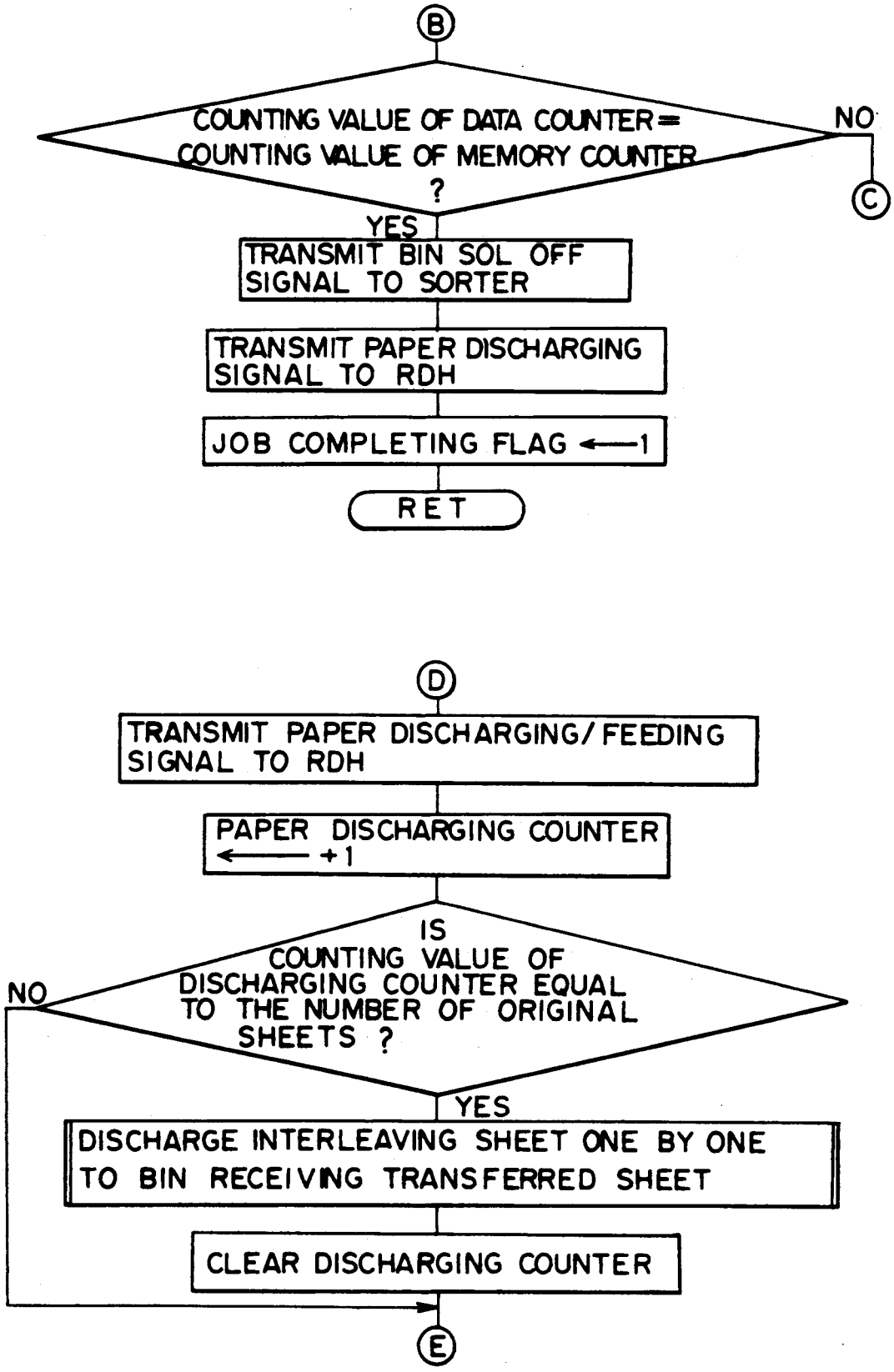

FIGS. 13*a* and 13*b* shows processings of the image forming apparatus when transferred and interleaving sheets are discharged. This processing relates to a control operation of the image forming apparatus when the transferred sheet 15 is discharged from the apparatus body to the sorter 14. In this case, after the discharge of the transferred sheet 15 is detected, data are read from a memory corresponding to a bin for receiving the discharged sheet and the decremental operation of a memory counter is performed by one. Next, data about the next bin are read from the memory. If these data exist in the memory, a bin switching signal is transmitted to the sorter 14 to designate a new bin for receiving the discharged sheet. In contrast to this, if there are no data about the next bin, the next data are read from the memory. If there are no data in all the memories, it is considered as the completion of JOB and commands for discharging the original sheet are transmitted to the original-recyclic automatic feeder (RDH) 10. The transferred sheet 15 is discharged onto each of all the bins designated with respect to one sheet of the original. If there are still data in the memories, commands for discharging the original sheet and feeding another original sheet are transmitted to the original-recyclic automatic feeder (RDH) 10. In this case, when the transferred sheet 15 is completely discharged onto each of the bins by an interleaving-sheet discharging means for every one copy, an interleaving or untransferred sheet is fed and discharged one by one from an unillustrated feeding unit onto each of the bins.

FIGS. 14*a* to 14*f* show concrete examples of the above transferred-sheet separate-section-copying-number page-order interleaving-sheet discharging control means. These examples relate to flows of the original, transferred and interleaving sheets when the original is constructed by two sheets and and two copies are made with respect to a section A and one copy is made with respect to a section B. In this case, originals a and b are arranged on an original base 59 above contact glass 58 on a side of the original-recyclic automatic feeder (RDH) 10. A first bin 60 and a second bin 61 are disposed on a side of the sorter 14.

Figure 14A:
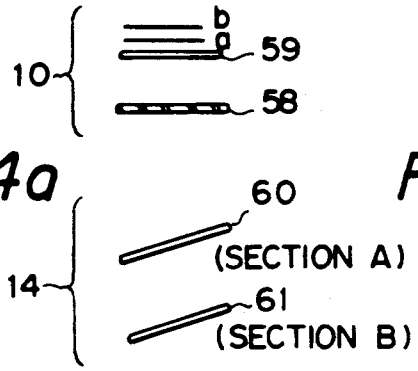
FIGS. 14*a* to 14*f* are explanatory views showing concrete processing flows of an original and a transferred sheet in the image forming apparatus.
Figure 14D:
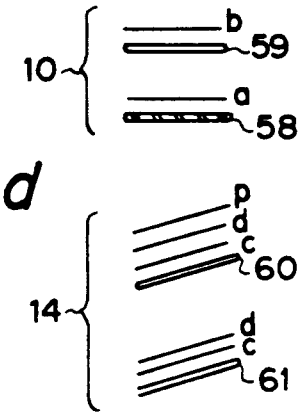
Figure 14B:
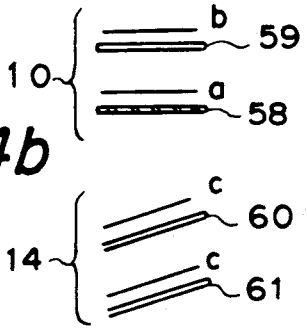

In FIG. 14*a*, the originals a and b are set on the original base 59 of the RDH 10 such that front faces of these originals are directed downward. In FIG. 14*b*, a starting key is pushed to turn on the image forming apparatus and the number of original sheets is checked. Thereafter, the first original a is fed onto the contact glass 58 and an exposure operation is then performed. At this time, a transferred sheet c is discharged onto the first bin 60 and the second bin 61 one by one in a state in which a rear face of the transferred sheet c is directed upward. In FIG. 14*c*, the first original a is discharged onto the original base 59 and the second original b is fed onto the contact glass 58. An exposed and transferred sheet d is discharged to the first bin 60 and the second bin 61 one by one in a state in which a rear face of the transferred sheet d is directed upward. At this time, the set number of copies discharged onto the second bin 61 with respect to the business section B is equal to one. In this state, JOB is completed with respect to the second bin 61, but is not completed with respect to the first bin 60 so that the next operation is continuously performed. In FIG. 14*d*, the second original b is discharged onto the original base and the first original a is again fed onto the contact glass 58. Since one transferred sheet c and one transferred sheet d are discharged onto each of the first bin 60 and the second bin 61, an interleaving or untransferred sheet P is discharged onto the first bin 60. At this time, the JOB is completed with respect to the second bin 61 so that no interleaving sheet P is discharged onto the second bin 61.

Figure 14E:
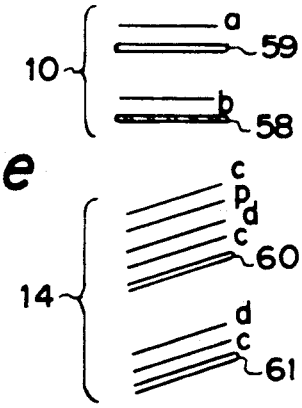
Figure 14C:
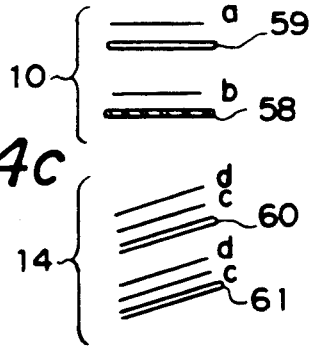
Figure 14F:
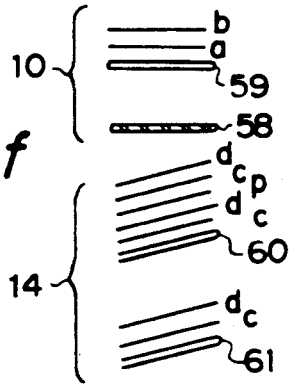

In FIG. 14*e*, the original a is exposed and is then discharged and the original b is fed onto the contact glass 58. The transferred sheet c is discharged onto the interleaving sheet P on the first bin 60 in a state in which a rear face of the transferred sheet c is directed upward. In FIG. 14*f*, the original b on the contact glass 58 is exposed and is then discharged. A transferred sheet d with respect to this original b is discharged onto the transferred sheet c on the first bin 60. In this state, two transferred sheets c and two transferred sheets d are discharged onto the first bin 60. Further, one transferred sheet c and one transferred sheet d are discharged onto the second bin 61. The interleaving sheet P is discharged onto the first bin 60 after one transferred sheet c and one transferred sheet d are discharged onto this first bin 60. Operating states of the originals a and b are returned to their original states. Accordingly, all the JOBs are thus completed. As mentioned above, in the image forming apparatus, it is not necessary to change hardware since a control operation of the sorter 14 is performed by software. Accordingly, it is possible to provide a sorting structure cheaply manufactured in comparison with the general image forming apparatus.

Further, it is possible to simply perform the control operation of the sorter 14.

Figure 15:
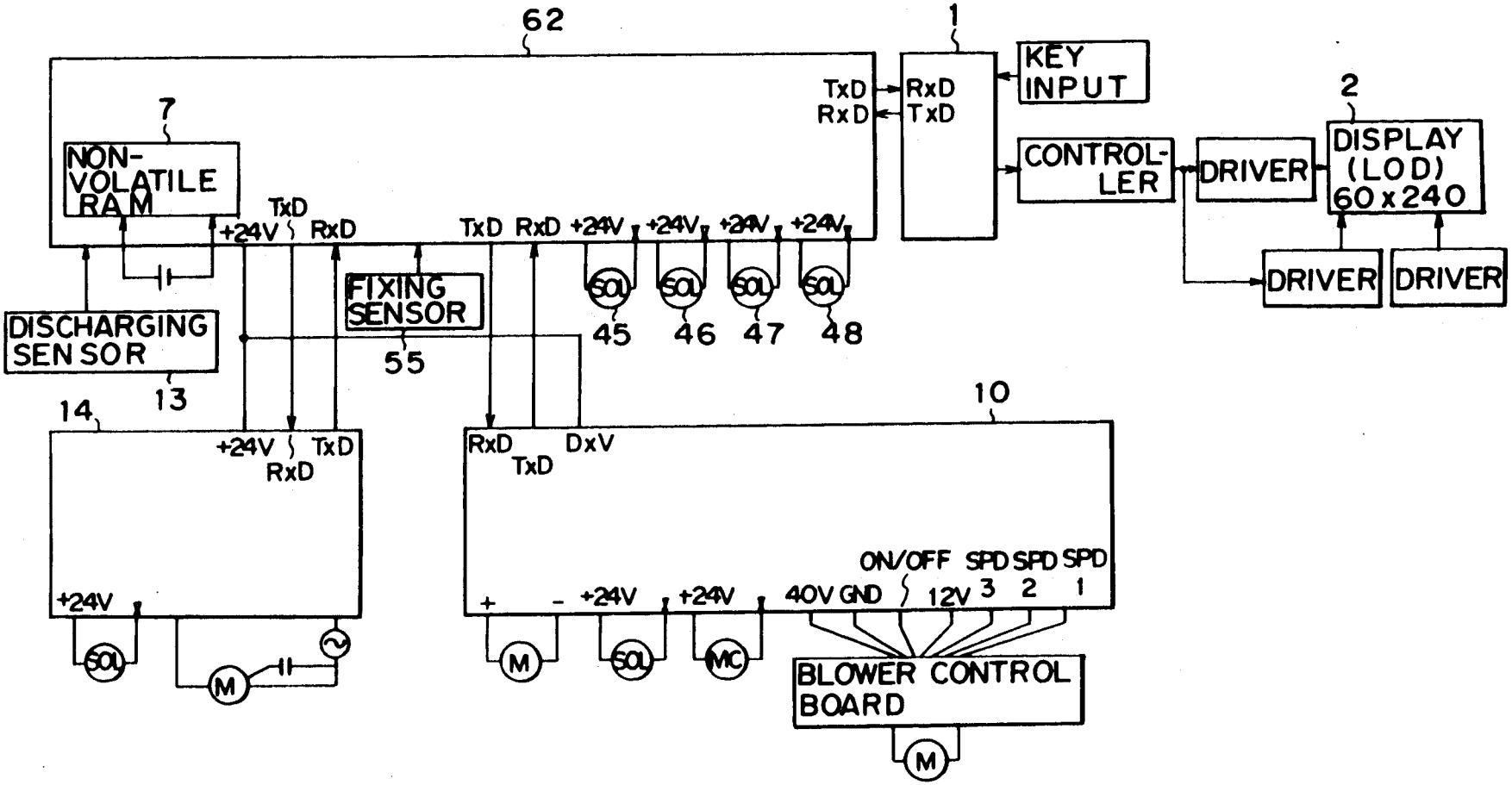
FIG. 15 is a block diagram schematically showing an internal structure of the image forming apparatus.

FIG. 15 is a block diagram showing the construction of the image forming apparatus. As shown in FIG. 15, the image forming apparatus can be generally divided into the sorter 14, the RDH 10, the operating section 1, the display 2 and a main electric circuit 62. If data indicative of the number of copies for every business section are inputted and stored once to the non-volatile RAM 7, it is possible to continuously use these data. Further, if the sorter 14 is combined with the RDH 10, the transferred sheet discharged onto each of the bins of the sorter 14 can be arranged in a page order of the original for every one copy. Thus, it is possible to simplify a sorting operation.

Figure 25:
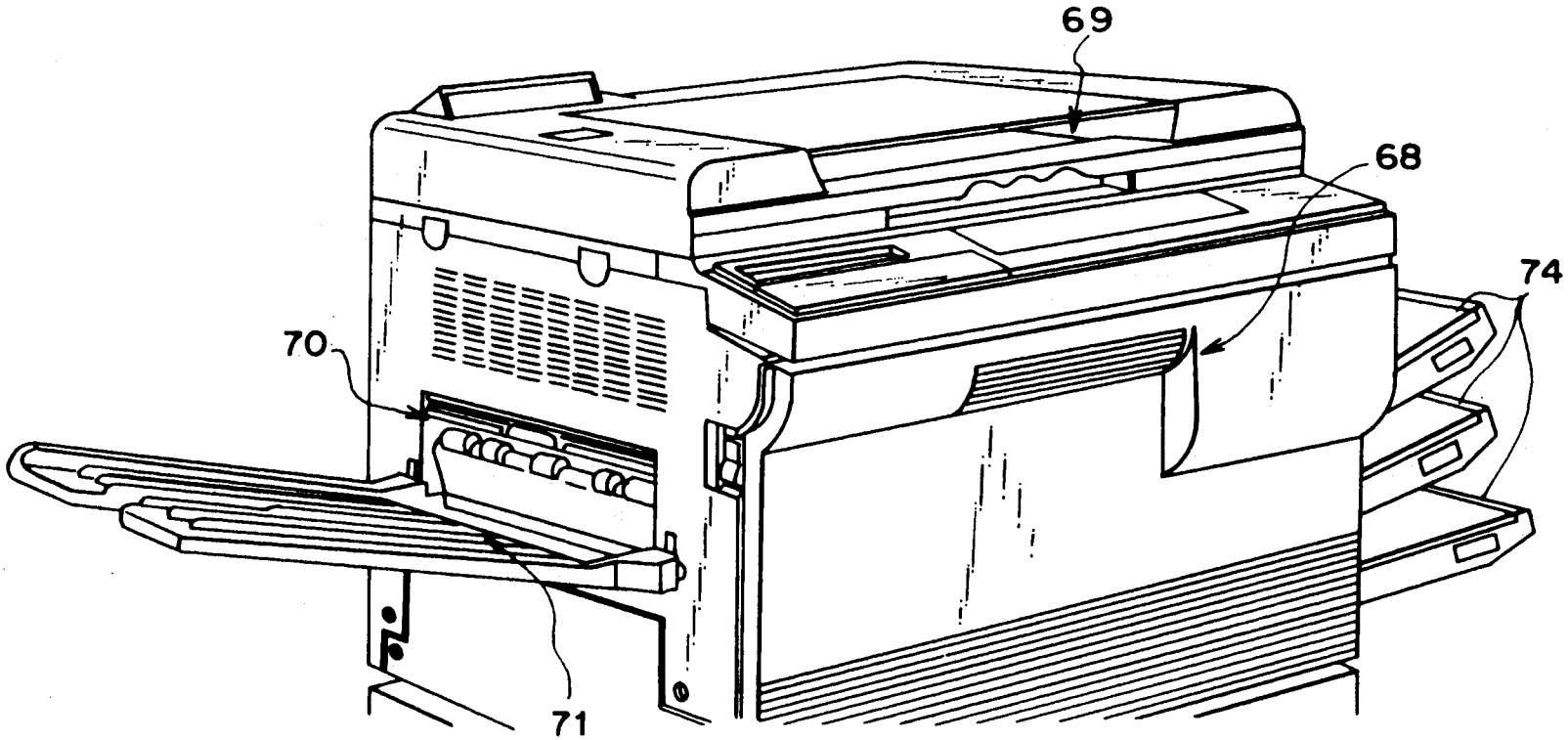
FIG. 25 is a perspective view showing an appearance of the image forming apparatus in the present invention.

An image forming apparatus having a second and third structures in accordance with a second embodiment of the present invention will next be described with reference to FIGS. 16 and 25. FIG. 25 shows one example of the image forming apparatus in this second embodiment of the present invention. This image forming apparatus has at least an image forming processing means and an optical scanning means within a copying machine body 68. The image forming processing means and the optical scanning means are not shown in FIG. 25. A recyclic automatic original feeder (RADF) 69 is disposed above the copying machine body 68. A paper discharging tray 71 is attached to a paper discharging section 70 disposed on a side of the copying machine body 68.

Such an image forming apparatus has an unillustrated controller. This controller has a white-paper copying-mode selecting means having a processing flow shown in FIG. 16. When a plurality of copies are made, this white-paper copying-mode selecting means can select a mode for discharging an interleaving sheet copied as white paper every time one of the copies is completely made. This white-paper copying-mode selecting means is set such that no interleaving sheet as a white paper copy is inserted after a final copy with respect to the plural copies.

In such a structure, processing of the white-paper copying-mode selecting means will next be described with reference to FIG. 16. First, it is judged whether it is an interleaving sheet mode or not. Namely, it is judged whether or not an operator selects this interleaving sheet mode. If the operator selects this mode, it is judged whether plural copies are made or not. In the case of only one copy, no interleaving sheet is naturally required. In contrast to this, in the case of plural copies, it is judged whether or not it is a final page with respect to each of the copies. When the final page copy is completely made, one white paper copy is made to insert an interleaving paper sheet after the final page copy is completely made. The above operations are repeatedly performed so that the interleaving paper sheet is inserted for every copy so as to divide or sort the copies. At this time, it is judged whether it is a final copy or not with respect to the plural copies. Namely, no interleaving sheet is inserted when the copying operation is finally completed. Thus, no paper is uselessly wasted and paper is saved.

Figure 17:
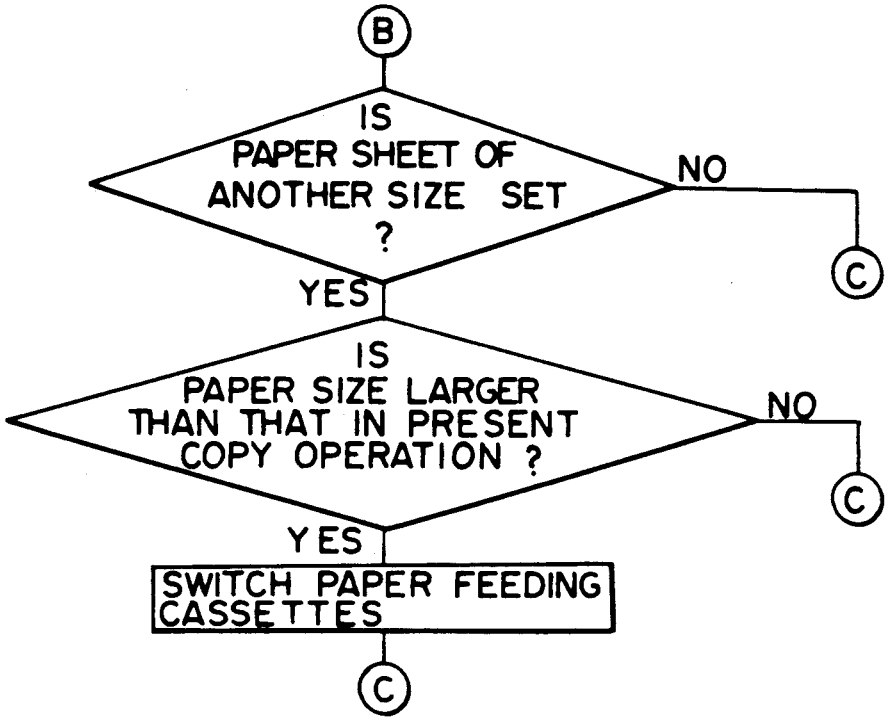
FIG. 17 is a flow chart showing the operation of a paper-size-changing white-paper copying-mode selecting means disposed in an image forming apparatus having a fourth structure in accordance with a third embodiment of the present invention.
Figure 18:
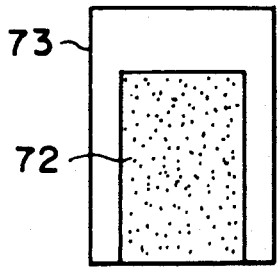
FIG. 18 is a plan view showing a case in which an interleaving or untransferred sheet of paper having a size different from that of copying paper is inserted into paper sheets.

An image forming apparatus having a fourth structure in accordance with a third embodiment of the present invention will next be described with reference to FIGS. 17 and 18. In this fourth embodiment, a plurality of paper feeding means 74 are disposed in the above image forming apparatus having the second and third structures and shown in FIG. 25 in the second embodiment of the present invention. The image forming apparatus in the fourth embodiment further has a paper-size-changing white-paper copying-mode selecting means for performing the following operation and disposed within a controller for controlling an operation of the image forming apparatus. Namely, when a plurality of copies are made, the paper feeding means 74 feeds a sheet of paper having a size different from a copying size used at the present time every time one of the copies is completely made. The paper-size-changing white-paper copying-mode selecting means can select a mode for discharging this fed sheet of paper as an interleaving sheet of a white paper copy, In such a structure, processing of the paper-size-changing white-paper copying-mode selecting means will next be described with reference to a flow chart shown in FIG. 17. The paper-size-changing white-paper copying-mode selecting means can be operated by inserting the processing flow shown in FIG. 17 between portions B and C in the above processing flow shown in FIG. 16. Namely, it is first judged whether or not a paper size different from that used in the present copying operation is set in the copying machine body 68. When such a paper size is set, it is further judged whether or not this paper size is larger than the paper size used in the present copying operation. If the larger paper size is set, a paper feeding operation is performed by paper feeding means 74 by switching a cassette used in the present copying operation to a larger cassette of the larger paper size. Thus, an interleaving paper sheet having a size larger than that of a sheet of copying paper 72 is fed onto the paper discharging tray 71. FIG. 18 shows a state in which the interleaving sheet 73 is inserted onto the sheet of copying paper 72. Thus, it is possible to clearly recognize a division or partition of copy by using the interleaving sheet 73 having a size different from the present paper size. Accordingly, it is very easy for an operator to treat the copied sheets after the copying operation.

Figure 19:
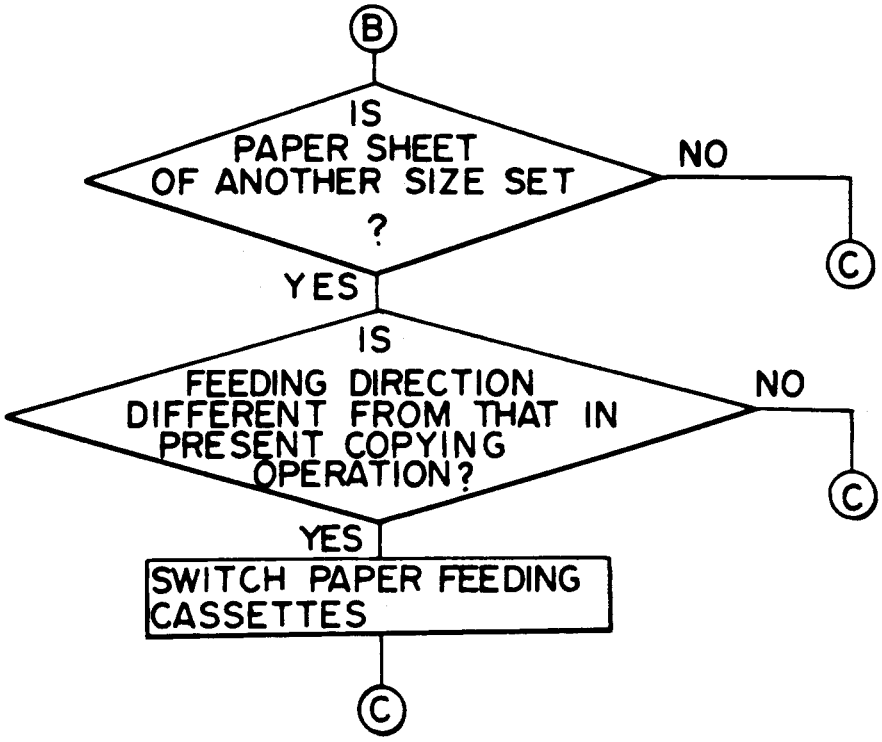
FIG. 19 is a flow chart showing the operation of a feeding-direction-changing white-paper coping-mode selecting means disposed in an image forming apparatus having a fifth structure in accordance with a fourth embodiment of the present invention.
Figure 21:
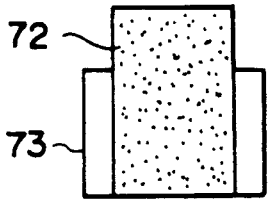
FIG. 21 is a plan view showing a case in which the interleaving sheet of paper is inserted into paper sheets in a direction different from the inserting direction shown in FIG. 20.

An image forming apparatus having a fifth structure in accordance with a fourth embodiment of the present invention will next be described with reference to FIGS. 19 and 21. This image forming apparatus has a plurality of paper feeding means 74 which can feed a sheet of paper in a direction different from a feeding direction set in the above image forming apparatus shown in FIG. 25. This image forming apparatus further has a feeding-direction-changing white-paper copying-mode selecting means for performing the following operation within a controller for controlling an operation of the image forming apparatus. Namely, when a plurality of copies are made, the paper feeding means 74 feeds a sheet of paper in a direction different from a paper feeding direction set at the present time every time one of the copies is completely made. The feeding-direction-changing white-paper copying-mode selecting means can select a mode for discharging this fed sheet of paper as an interleaving sheet of a white paper copy.

Figure 20:
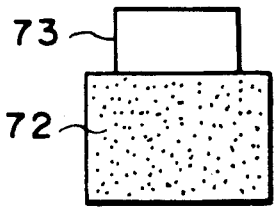
FIG. 20 is a plan view showing a case in which an interleaving sheet of paper is inserted into paper sheets in a direction different from the longitudinal direction of a sheet of copying paper.

In such a structure, processing of the feeding-direction-changing white-paper copying-mode selecting means will next by described with reference to a flow chart shown in FIG. 19. In this embodiment, the feeding-direction-changing white-paper copying-mode selecting means can be operated by inserting a processing flow shown in FIG. 19 between the portions B and C in the above processing flow shown in FIG. 16. Namely, when sheets of paper are set in the paper feeding means 74 in longitudinal and transversal directions instead of a sheet of paper having a size larger than that of copying paper 72 as an interleaving paper sheet, a sheet of paper set in a direction different from the paper feeding direction set in the present copying operation is fed by the paper feeding means 74 as an interleaving paper sheet to divide or sort copied sheets every plural copies. FIG. 20 shows a state in which the interleaving sheet 73 is inserted onto a sheet of copying paper 72 in the longitudinal direction. FIG. 21 shows a state in which the interleaving sheet 73 is inserted onto a sheet of copying paper 72 in the transversal direction. Accordingly, it is possible to obtain effects similar to those obtained when a large-sized paper sheet is used as the interleaving sheet in the above image forming apparatus having the fourth structure.

An image forming apparatus having sixth, eighth and ninth structures in accordance with a fifth embodiment of the present invention will next be described with reference to FIGS. 22 and 23. In this embodiment, the following condition is set with respect to the controller for controlling the operation of the above image forming apparatus shown in FIG. 25 and having each of the second to fifth structures. Namely, in a process for making a white paper copy, the controller is set such that no unillustrated charger for charge is operated as an image forming processing means disposed within the copying machine body 68.

Such a condition is set for the following reasons. The white paper copy is a sheet of paper copied in a white paper state. In the present invention, when this white paper copy is inserted onto the paper discharging tray 71 as an interleaving paper sheet, a final object is to provide how to divide or sort a plurality of copied paper sheets with respect to plural copies. In this case, no original is set on a contact glass face arranged on the copying machine body 68 shown in FIG. 25. However, a dirty portion of a belt disposed in the recyclic automatic original feeder (RADF) 69 is copied and formed as a copied image. Therefore, the white paper copy is not white completely, but is partially stained with toner. Further, an image is slightly formed on a sheet of copying paper so that toner is uselessly wasted and it is not economical.

Figure 16:
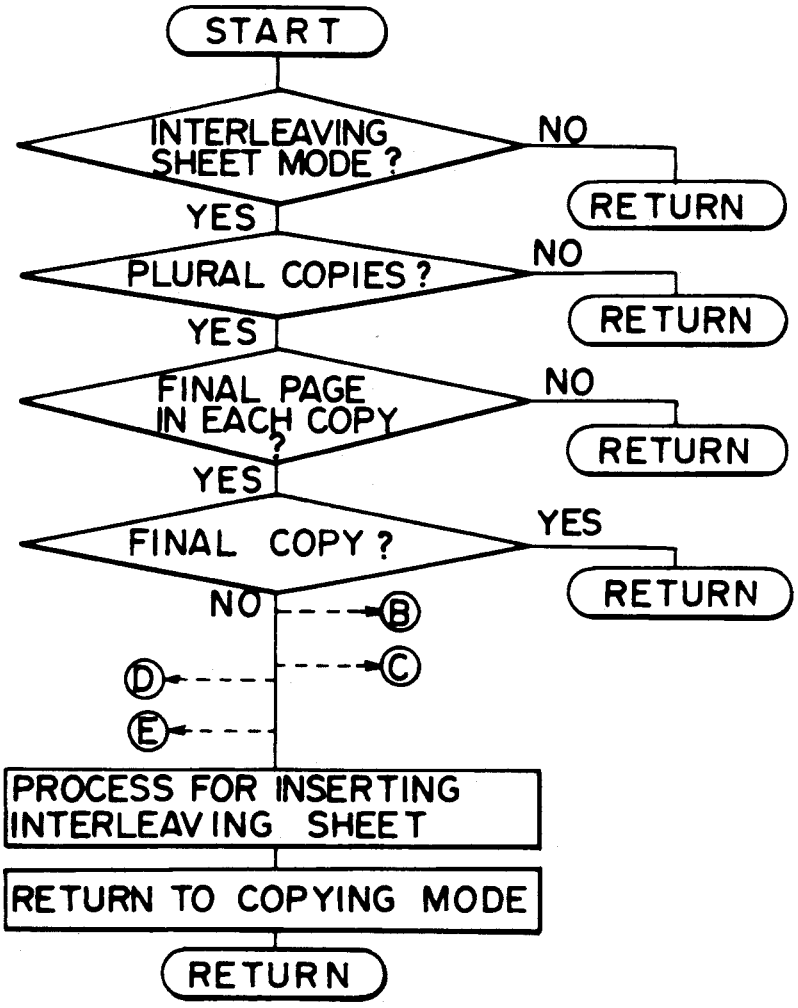
FIG. 16 is a flow chart showing the operation of a white-paper copying-mode selecting means disposed in an image forming apparatus having second and third structures in accordance with a second embodiment of the present invention.
Figure 22:
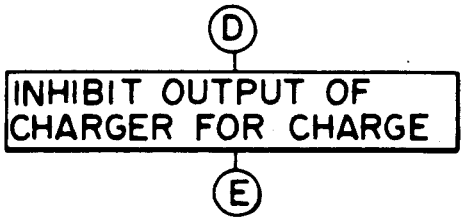
FIG. 22 is a flow chart showing the control operation of a charger for charge used as an image forming processing means in an image forming apparatus having sixth, eight and ninth structures in accordance with a fifth embodiment of the present invention.
Figure 23:
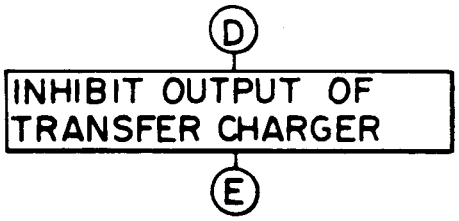
FIG. 23 is a flow chart showing the control operation of a transfer charger used as the image forming processing means.

Accordingly, in this embodiment, a processing flow shown in FIGS. 22 or 23 is inserted between portions D and E in the processing flow shown in FIG. 16. Namely, in the processing flow shown in FIG. 22, no image data are outputted to the charger for charge when a white paper copy is made. In the processing flow shown in FIG. 23, no image data are outputted to the transfer charger when a white paper copy is made. These processes constitute one process of the image forming means. When the image forming apparatus does not have any one of these processes, no image is formed on a sheet of copying paper. Thus, there is no dirty image with respect to the white paper copy made by this image forming apparatus so that toner cannot be wasted and can be saved.

Figure 24:
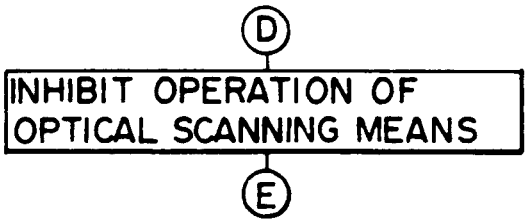
FIG. 24 is a flow chart showing the control operation of an optical scanning means disposed in an image forming apparatus having a seventh structure in accordance with a sixth embodiment of the present invention.

An image forming apparatus having a seventh structure in accordance with a sixth structure of the present invention will next be described with reference to FIG. 24. In the above sixth, eighth and ninth structures of the present invention, the white paper copy can be made by stopping the operation of a means required to form an image. However, it is possible to obtain similar effects by erasing a formed image by applying a high bias to an eraser, a developing section, etc. In this case, when no image forming process is executed, it is not necessary to scan an original by an optical system. Accordingly, it is not necessary to turn on a light source for the optical system and it is sufficient to convey only an interleaving sheet of paper. Concretely, a processing flow shown in FIG. 24 is inserted between the portions D and E in the processing flow shown in FIG. 16. Namely, in this case, an optical scanning means such as a halogen lamp for scanning the original and constituting one image forming means is not operated in a process for making the white paper copy. Thus, no time required to scan the original is uselessly wasted and no time and power required to operate the power source are uselessly wasted, which is economically advantageous in operation of the image forming apparatus.

As mentioned above, in accordance with a first structure of the present invention, an image forming apparatus comprises input means for inputting the number of copies for every distributing place; memory means for storing the number of copies inputted by the input means for every distributing place; display means for displaying the number of copies inputted by the input means for every distributing place; original automatic feeding means for returning an exposed sheet of an original to an uppermost position of this original; means for feeding a sheet to be transferred; means for reversing the transferred sheet; collective sorting means for collecting and sorting the transferred sheet; means for detecting discharge of the transferred sheet; and transferred-sheet separate-section-copying-number page-order interleaving-sheet discharging control means having separate-section copying-number discharging means, page-order discharging means and interleaving-sheet discharging means. The separate-section copying-number discharging means discharges the transferred sheet to each of bins disposed in the collective sorting means in accordance with the number of copies of the original inputted by the input means for every distributing place. The page-order discharging means arranges and discharges the transferred sheet in a page order of the original. The interleaving-sheet discharging means discharges an interleaving sheet of paper every time the transferred sheet is discharged by one copy.

In the first structure of the present invention, an operator inputs the number of distributed copies for every business section by the input means. Data indicative of the number of distributed copies for every business section are stored to a memory in an inputting order. After a copying operation is performed, a transferred sheet is discharged onto each of the bins in the collective sorting means in accordance with the number of copies stored to the memory so that the number of operations of an operator can be reduced. Further, in this image forming apparatus, the operation of a sorted is controlled by software and it is not necessary to change hardware so that the image forming apparatus can be cheaply manufactured and can be easily operated. Further, the working efficiency of an operator can be further improved by inserting an interleaving sheet by using the interleaving sheet discharging means every time the transferred sheet is discharged by one copy.

In accordance with a second structure of the present invention, a controller of an image forming apparatus has at least image forming processing means and optical scanning means within an apparatus body and a recyclic automatic original feeder outside the apparatus body. The controller comprises white-paper copying-mode selecting means capable of selecting a mode for discharging an interleaving sheet of paper as a white paper copy every time one of plural copies is completely made. In the second structure, when a plurality of copies are made by the white-paper copying-mode selecting means, it is possible to divide or sort copied sheets every copy by inserting an interleaving sheet for every one copy in accordance with necessity. Thus, the working efficiency of an operator can be greatly improved.

In accordance with a third structure of the present invention, the white-paper copying-mode selecting means in the second structure is constructed such that no interleaving sheet as a white paper copy is inserted after a final copy with respect to the plural copies. Accordingly, there is no useless copy and paper is saved in the third structure.

In accordance with a fourth structure of the present invention, a controller of an image forming apparatus has at least image forming processing means and optical scanning means within an apparatus body and a recyclic automatic original feeder and a plurality of paper feeding means outside the apparatus body. The plural paper feeding means feeds a sheet of paper having a size different from a copying size used at the present time every time one of plural copies is completely made. The controller comprises paper-size-changing white-paper copying-mode selecting means capable of selecting a mode for discharging this fed sheet of paper as an interleaving sheet of a white paper copy.

In the fourth structure of the present invention, a sheet of paper having a size (e.g., a larger size) different from a paper size used in the present copying operation is inserted as an interleaving paper sheet from the plural paper feeding means by the paper-size-changing white-paper copying-mode selecting means. Accordingly, respective partitions between the copies can be clearly recognized so that working efficiency can be improved.

In accordance with a fifth structure of the present invention, a controller of an image forming apparatus has at least image forming processing means and optical scanning means within an apparatus body and a recyclic automatic original feeder and a plurality of paper feeding means outside the apparatus body. The plural paper feeding means can feed a sheet of paper in different directions. The plural paper feeding means feeds the sheet of paper in a direction different from a feeding direction set at the present time every time one of plural copies is completely made. The controller comprises feeding-direction-changing white-paper copying-mode selecting means capable of selecting a mode for discharging this fed sheet of paper as an interleaving sheet of a white paper copy.

In the fifth structure of the present invention, a sheet of paper fed in a direction different from a feeding direction set in the present copying operation is inserted as an interleaving paper sheet from the plural paper feeding means by the feeding-direction-changing white-paper copying-mode selecting means. Accordingly, respective partitions between the copies can be clearly recognized so that working efficiency can be improved.

In accordance with a sixth structure of the present invention, at least one of the image forming processing means is not operated in a process for making the white paper copy in the second, fourth and fifth structures. Accordingly, it is possible to make a white paper copy having no slight image and no dirty portion on an interleaving sheet copied as a white paper sheet.

In accordance with a seventh structure of the present invention, no optical scanning means for scanning an original is operated in a process for making the white paper copy in the second, fourth and fifth structures. Accordingly, no time required to perform the scanning operation is uselessly wasted and no power of a light source used within a scanning unit is uselessly consumed.

In accordance with an eighth structure of the present invention, the image forming processing means is constructed by a charger for charge in the sixth structure. In the eighth structure, no charger for charge in the image forming processing means is operated in a process for making the white paper copy. Accordingly, no charge is moved onto a photosensitive body so that it is possible to make a white paper copy having no slight image and no dirty portion on an interleaving sheet copied as a white paper sheet.

In accordance with a ninth structure of the present invention, the image forming processing means is constructed by a transfer charger in the sixth structure. In the ninth structure, no transfer charger in the image forming processing means is operated in a process for making the white paper copy. Accordingly, no image on a photosensitive body is transferred onto a sheet of paper so that it is possible to make a white paper copy having no slight image and no dirty portion on an interleaving sheet copied as a white paper sheet.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus having sorting means with a plurality of bins, comprising:
   - input means for inputting a number of copies to be made for each of said bins, such that a first number of copies can be inputted for one of said plurality of bins and a second number of copies different from the first number of copies can be inputted for a second one of said plurality of bins;
   - memory means for storing said inputted number of copies for each of said bins;
   - means for feeding sheets to be transferred;
   - discharging means for discharging said transferred sheets to each of said bins; and
   - control means for controlling said discharging means so as to discharge said transferred sheet to each of said bins in accordance with said inputted number of copies.

2. The image forming apparatus according to claim 1, further comprising original automatic feeding means for further a plurality of original sheets.

3. The image forming apparatus according to claim 2, wherein said original automatic feeding means is adapted to return an exposed sheets of said original sheets to an uppermost position of said original sheets.

4. The image forming apparatus according to claim 2, further comprising reversing means for said transferred sheet in order to arrange said transferred sheets in a page order of said original sheets.

5. The image forming apparatus according to claim 2, wherein said control means is adapted to control said discharging means so as to discharge an interleaving sheet of paper every time said transferred sheet is discharged by one copy.

* * * * *